US009386834B2

(12) United States Patent
Bitoh

(10) Patent No.: US 9,386,834 B2
(45) Date of Patent: Jul. 12, 2016

(54) NAIL PRINTING APPARATUS AND PRINTING CONTROL METHOD FOR NAIL PRINT APPARATUS

(71) Applicant: CASIO COMPUTER CO., LTD., Tokyo (JP)

(72) Inventor: Hiroyasu Bitoh, Ome (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/334,542

(22) Filed: Jul. 17, 2014

(65) Prior Publication Data

US 2015/0020834 A1 Jan. 22, 2015

(30) Foreign Application Priority Data

Jul. 18, 2013 (JP) ..... 2013-148992

(51) Int. Cl.
*A45D 29/00* (2006.01)

(52) U.S. Cl.
CPC ..... *A45D 29/00* (2013.01); *A45D 2029/005* (2013.01)

(58) Field of Classification Search
None
See application file for complete search history.

(56) References Cited

U.S. PATENT DOCUMENTS 6,286,517 B1 * 9/2001 Weber ..... A45D 29/00 132/200
2012/0274683 A1 * 11/2012 Yamasaki ..... B41J 3/4073 347/2

FOREIGN PATENT DOCUMENTS

JP H07-266789 A 10/1995

* cited by examiner

*Primary Examiner* — Fan Zhang
(74) *Attorney, Agent, or Firm* — Fitch Even Tabin & Flannery LLP

(57) ABSTRACT

A nail printing apparatus includes a finger/toe placement section, a drawing tool touching a finger/toe nail and making drawing on the finger/toe nail, and a drive unit which moves the drawing tool. When the drive unit moves the drawing tool while drawing, the drive unit is controlled to perform drawing direction limiting processing in which the drawing tool is allowed to move from a first to a second point of the surface of the nail which is lower than the first point and the drawing tool is prohibited from moving from the second to the first point in a first area of the nail surface set on one side of the nail center line, and in a second area of the nail surface set on the other side of the center line.

18 Claims, 11 Drawing Sheets

NAIL PRINTING APPARATUS AND PRINTING CONTROL METHOD FOR NAIL PRINT APPARATUS

CROSS-REFERENCE TO RELATED APPLICATIONS

This application is based upon and claims the benefit of priority under 35 USC 119 of Japanese Patent Application No. 2013-148992 filed on Jul. 18, 2013, the entire content of which, including the description, claims, drawings and abstract, is incorporated herein by reference in its entirety.

BACKGROUND OF THE INVENTION

1. Field of the Invention

The present invention relates to a nail printing apparatus and a print control method for a nail printing apparatus.

2. Description of the Related Art

A plotting print apparatus provided with a drawing head to which a pen (drawing tool) is attached has been known. Such a print apparatus performs drawing with the tip of the pen touching a sheet of paper (or an object).

For example, Japanese Unexamined Patent Application Publication No. 7-266789 discloses the technique of detecting the inclination angle of a table, on which a planar sheet of paper is to be placed, with respect to a floor surface; and maintaining a constant pen pressure, a constant speed at which the pen moves downward, and a constant moving speed of a drawing head in accordance with the inclination angle.

The technique disclosed in the above-mentioned document can keep the pen pressure etc. unchanged regardless of the change in inclination angle of the table when drawing is performed on a planar sheet of paper placed on the table.

When a plotter is used as a nail printing apparatus, an object on which a drawing is to be made is a nail curving in its width direction, the widthwise center part of the nail being at a high position. The level of the surface to be touched by a pen tip therefore changes in the vertical direction (or height direction).

When drawing starts from an edge part of a nail at a relatively low position to the center part of the nail at a relatively high position, that is, when a pen is moved in the direction to go up the inclined surface a nail, a force pressing the nail in the horizontal direction is applied to the nail. Such a force may move the finger in the horizontal direction.

If a moving pen presses a nail and causes the finger to move, the finish of the nail print is deteriorated in quality.

BRIEF SUMMARY OF THE INVENTION

The present invention provides a nail printing apparatus to make a drawing on a nail with a pen and advantageously achieves a high-definition image by preventing the pen from pressing a nail in the lateral direction and preventing the finger or toe from moving during the drawing.

According to an aspect of the present invention, there is provided a nail printing apparatus including: a finger/toe placement section including a placement surface on which at least one of a finger and a toe is placed, the at least one of the finger and the toe having a nail on which a drawing is to be made; a drawing tool which touches a surface of the nail of the at least one of the finger and the toe placed on the placement surface and makes the drawing on the surface of the nail; a drive unit which moves the drawing tool; and a control unit which controls the drive unit, wherein when the drive unit moves the drawing tool for the drawing between a first point and a second point, which is lower in height above the placement surface than the first point, on the surface of the nail, the control unit controls the drive unit so as to perform drawing direction limiting processing in which the drawing tool is allowed to move from the first point to the second point but is not allowed to move from the second point to the first point in a first area and a second area of the surface of the nail, the first area being set on one side of a center line of the nail in a width direction of the nail and including a part of an edge of the nail on the one side, the second area being set on the other side of the center line of the nail in the width direction and including a part of an edge of the nail on the other side.

According to another aspect of the present invention, there is provided a printing control method for a nail printing apparatus including a finger/toe placement section including a placement surface on which at least one of a finger and a toe is placed, the at least one of the finger and the toe having a nail on which a drawing is to be made; and a drawing tool which touches a surface of the nail of the at least one of the finger and the toe placed on the placement surface and makes the drawing on the surface of the nail, the method including: performing drawing direction limiting processing when the drawing tool is moved for the drawing between a first point and a second point, which is lower in height above the placement surface than the first point, on the surface of the nail in a first area and a second area of the surface of the nail, the first area being set on one side of a center line of the nail in a width direction of the nail and including a part of an edge of the nail on the one side, the second area being set on the other side of the center line of the nail in the width direction and including a part of an edge of the nail on the other side, the drawing direction limiting processing being processing in which the drawing tool is allowed to move from the first point to the second point but is not allowed to move from the second point to the first point.

BRIEF DESCRIPTION OF THE SEVERAL VIEWS OF THE DRAWING

FIG. 4A is a side view of the pen carriage and pen, FIG. 4B is a top view of the pen carriage and pen, seen from the direction of arrow b of FIG. 4A, and FIG. 4C is a front view of the pen carriage and pen, seen from the direction of arrow c of FIG. 4A;

FIG. 6A shows the case in which the inclination angle of a nail is 0°, FIG. 6B shows a pen moving up the inclined surface of a nail when the inclination angle of the nail is 30°, FIG. 6C shows a pen moving up the inclined surface of a nail when the inclination angle of the nail is 45°, FIG. 6D shows a pen moving up the inclined surface of a nail when the inclination angle of the nail is 60°, and FIG. 6E shows a pen moving down the inclined surface of a nail;

DETAILED DESCRIPTION OF THE INVENTION

Figure 1:
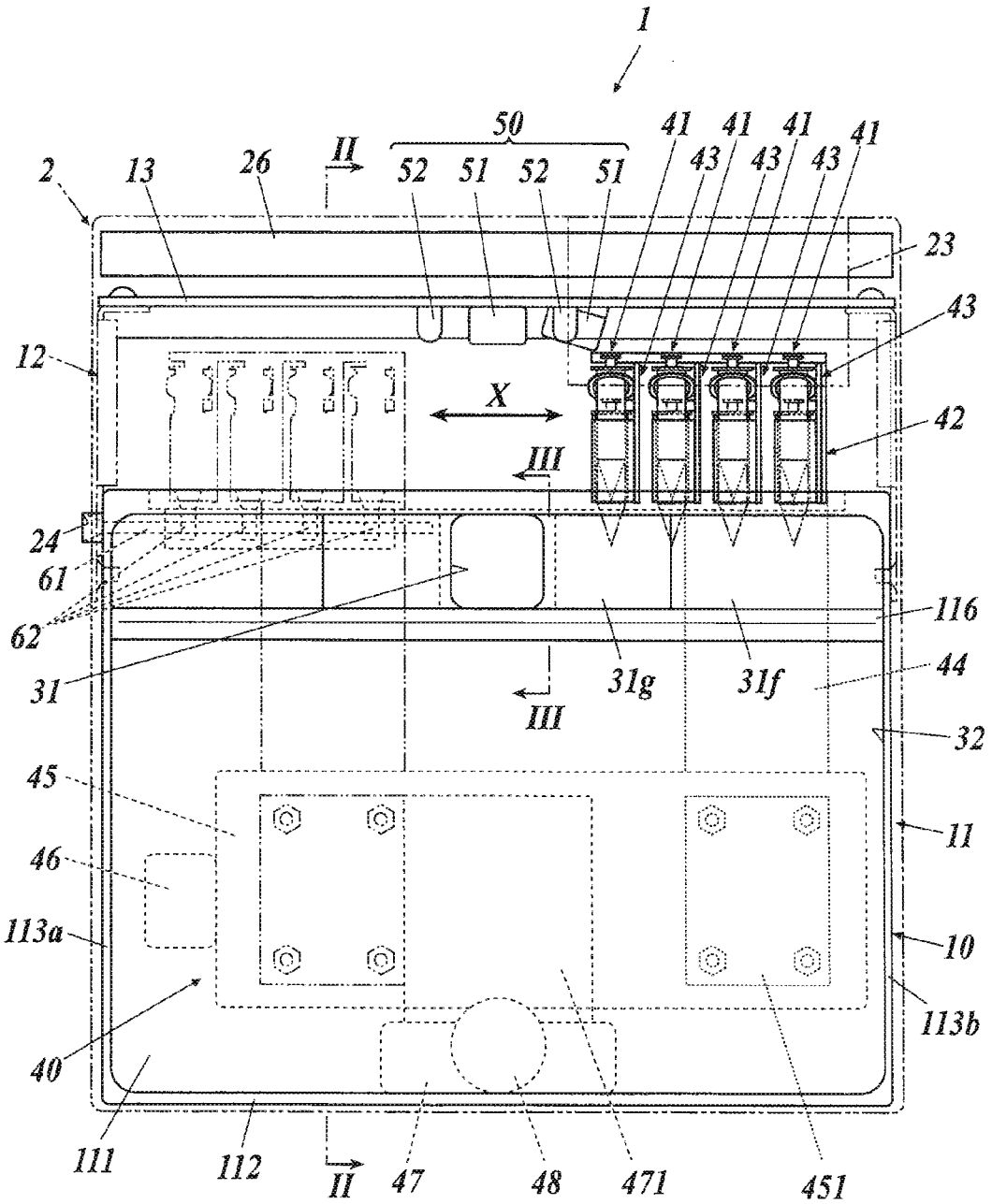
FIG. 1 is a front view of a nail printing apparatus in a first embodiment.

An embodiment of a nail printing apparatus according to the present invention is described in detail with reference to the drawings.

The embodiment described below has various limitations which are technically preferable to carry out the present invention. The scope of the present invention, however, is not limited to the embodiment below and the example shown in the drawings.

The nail printing apparatus of the embodiment makes drawings on nails of fingers (including thumbs). The target on which a drawing is to be made, however, is not limited to nails of fingers but may be nails of toes.

FIG. 1 is a front view showing the internal configuration of the nail printing apparatus 1.

Figure 2:
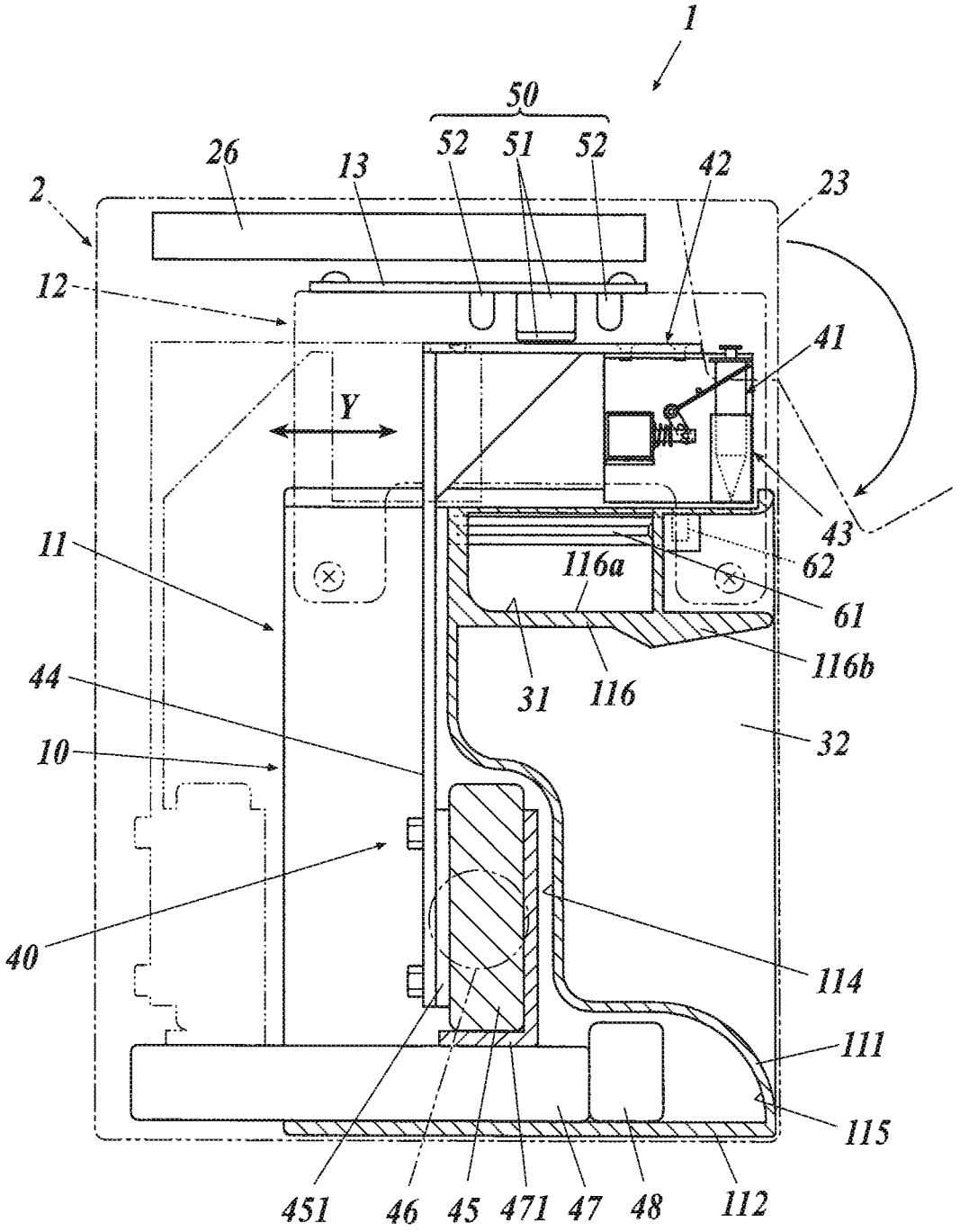
FIG. 2 is a cross-sectional view along the line II-II of FIG. 1.

FIG. 2 is a cross-sectional view showing the section along the line II-II of FIG. 1 seen from the direction of the arrows.

As shown in FIGS. 1 and 2, the nail printing apparatus 1 includes a case body 2 and an apparatus body 10 contained in the case body 2.

A cover 23 for pen replacement is disposed at one end part of the upper front side of the case body 2. The cover 23 can be opened and closed so that pens (drawing tools) 41 of a drawing unit 40, described later, can be replaced.

The cover 23 for pen replacement can turn about a hinge, for example, from a closing state to an opening state as shown in FIG. 2.

One lateral face (left face in FIG. 1 in this embodiment) of the case body 2 has a medium insertion/output opening 24 at the position corresponding to a pen warm-up section 61, which is described later. A drawing medium placed on the pen warm-up section 61 can be replaced through the medium insertion/output opening 24.

An operation unit 25 (see FIG. 5) is disposed on the upper surface (top board) of the case body 2.

The operation unit 25 is an input unit to receive various inputs from a user.

The operation unit 25 includes an electrical power switch button to power on the nail printing apparatus 1, a stop switch button to stop its operation, a design selection button to select a design image to be drawn on nails, a drawing start button to instruct start of drawing, and operation buttons for other various inputs, for example.

A display unit 26 is disposed on the upper surface (top board), almost in its center, of the case body 2.

The display unit 26 is constituted of a liquid crystal display (LCD), an organic electroluminescence display (organic EL), or another flat-panel display.

In the present embodiment, the display unit 26 displays an image obtained by photographing a printing finger U1 (i.e., a finger image including the image of nail T), the image of the outline of the nail T included in the nail image, a design selection screen for selecting a design image to be drawn on a nail T, a thumbnail image for checking a design, an instruction screen to provide various instructions, and the like, as appropriate.

A touch panel may be integrally formed on the surface of the display unit 26. In this case, various inputs can be made through touch operations of the surface of the display unit 26 with a stylus pen, which is like a stick writing implement having a sharp end, a finger tip, or the like (not shown).

The apparatus body 10, which is substantially formed in the shape of a box, includes a lower machine casing 11 disposed at the lower part in the case body 2, and an upper machine casing 12 disposed above the lower machine casing 11 and at the upper part in the case body 2.

The lower machine casing 11 is now described.

The lower machine casing 11 includes a back plate 111, a bottom plate 112, a pair of side plates 113*a* and 113*b*, an X-direction movement stage storage part 114, a Y-direction movement stage storage part 115, and a dividing wall 116.

The lower ends of the side plates 113*a* and 113*b* are connected to the both ends of the bottom plate 112, respectively, so that the side plates 113*a* and 113*b* are upright with respect to the bottom plate 112.

The lower part of the back plate 111 is caved in two steps toward the front (i.e., near side in the finger insertion direction) to form recesses.

The back plate 111, the end of which is connected to the front end of the bottom plate 112, partitions the space enclosed by the bottom plate 112 and the side plates 113*a* and 113*b* into a front space and a back space. The recessed spaces formed at the back of the back plate 111 are the X-direction movement stage storage part 114 and the Y-direction movement stage storage part 115 (see FIG. 2).

An X-direction movement stage 45 of a drawing unit 40 fits in the X-direction movement stage storage part 114 when the drawing unit 40 moves forward (i.e., to the near side in the finger insertion direction).

A Y-direction movement stage 47 of the drawing unit 40 is disposed in the Y-direction movement stage storage part 115.

The dividing wall 116 is disposed in the lower machine casing 11 so as to vertically partition the front space inside the lower machine casing 11 (i.e., the space on the near side in the finger insertion direction enclosed by the back plate 111, the bottom plate 112 and the side plates 113*a* and 113*b*).

The dividing wall 116 lies substantially horizontally so that the left and right ends of the dividing wall 116 are connected to the side plates 113*a* and 113*b*, respectively, and so that the rear end of the dividing wall 116 is connected to the back plate 111.

The lower machine casing 11 is provided with a finger fixation section 30 integrally.

The finger fixation section 30 is now described with reference to FIGS. 3A and 3B.

Figure 3A:
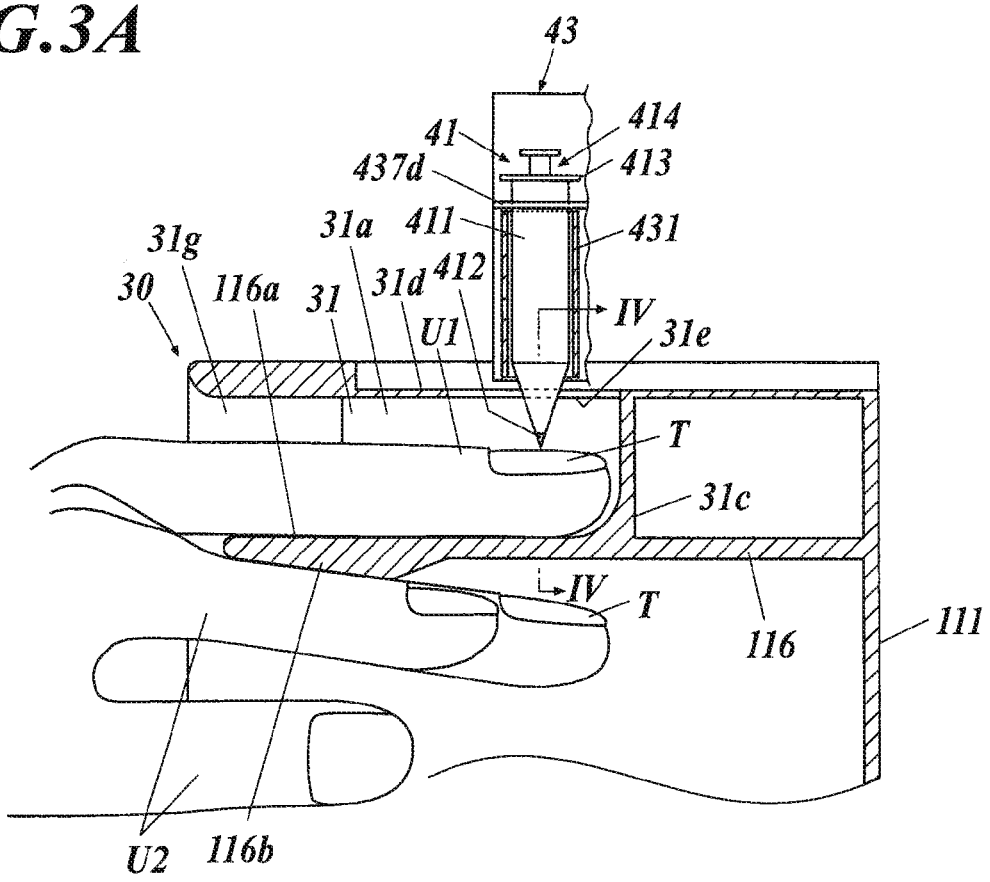
FIG. 3A is a cross-sectional view along the line of FIG. 1.

FIG. 3A is a cross-sectional view along the line of FIG. 1, the main part seen from the direction of the arrows.

Figure 3B:
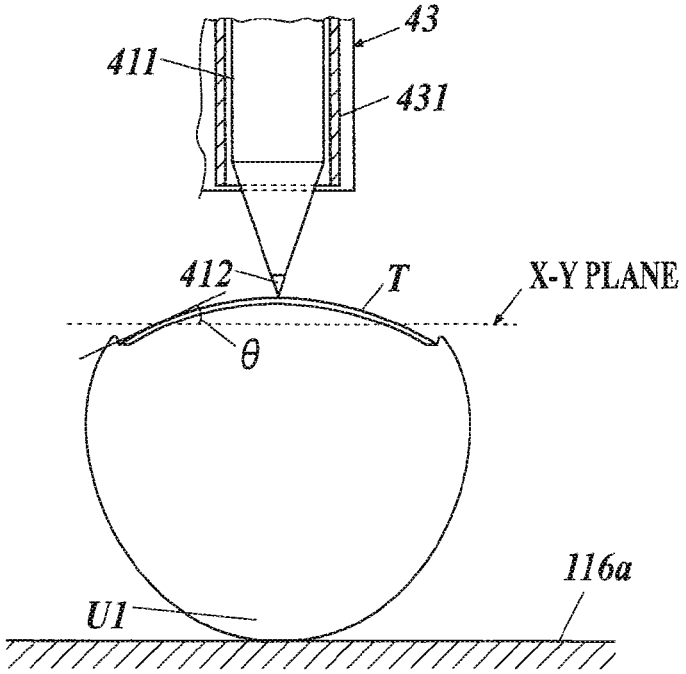
FIG. 3B is a cross-sectional view along the line IV-IV of FIG. 3A.

FIG. 3B is a cross-sectional view along the line IV-IV of FIG. 3A, the main part seen from the direction of the arrows.

The finger fixation section 30 is constituted of a finger receiving section 31 and a finger escape section 32. The finger receiving section 31 is a section to receive a finger U1 with a nail T on which a drawing is to be made ("printing finger U1", hereinbelow), and the finger escape section 32 is a section where fingers U2 other than the printing finger U1 ("non-printing fingers U2", hereinbelow) are inserted.

The finger receiving section 31 is disposed over the dividing wall 116 and almost at the center of the lower machine casing 11 in its width direction.

The lower space, formed by the dividing wall 116, of the lower machine casing 11 constitutes the finger escape section 32.

For example, when a drawing is to be made on the nail T of a ring finger as shown in FIG. 3A, the ring finger as a printing finger U1 is inserted in the finger receiving section 31, while the other four fingers (i.e., the thumb and index, middle, and little fingers) as non-printing fingers U2 are inserted in the finger escape section 32.

The finger receiving section 31 opens toward the front side (i.e., near side in the printing finger insertion direction) of the lower machine casing 11 and is defined by a finger placement section 116*a* at the bottom which constitutes a part of the dividing wall 116, partitions 31*a* at the both sides, and a partition 31*c* at the back.

The finger placement section 116*a* allows a finger (printing finger U1) with a drawing target nail T to be placed on an X-Y plane.

The finger receiving section 31 is defined by the ceiling 31*d* at the top.

The ceiling 31*d* has a window 31*e* through which the nail T of a printing finger U1 inserted in the finger receiving section 31 is exposed.

A front wall 31*f* which covers the front side, the both-side parts, of the lower machine casing 11 stands upright on the upper surface of the dividing wall 116.

A pair of guide walls 31*g* to guide a printing finger U1 into the finger receiving section 31 stands upright on the upper surface of the dividing wall 116. The guide walls 31*g* narrow from the end near the center of the front wall 31*f* toward the finger receiving section 31.

The dividing wall 116 can be held between a printing finger U1 inserted in the finger receiving section 31 and non-printing fingers U2 inserted in the finger escape section 32 by a user. Thus, a printing finger U1 inserted in the finger receiving section 31 can be stably fixed.

In this embodiment, the dividing wall 116 is provided with a bulge 116*b* bulging downward at the front end portion of the dividing wall 116.

The bulge 116*b* may form a taper portion whose thickness gradually decreases toward the near side and gradually increases toward the back. Alternatively, the entire thickness of the bulge 116*b* may be larger than that of the back part of the dividing wall 116.

As shown in FIG. 3A, providing the bulge 116*b* at the front end portion of the dividing wall 116 in such a way creates an interspace between nails T of non-printing fingers U2 and the dividing wall 116 when the non-printing fingers U2 after drawing are inserted in the finger escape section 32. This can prevent the nails T from coming into contact with the bottom surface of the dividing wall 116 and thus prevent ink from adhering to the apparatus. Therefore, designs drawn on the nails T are prevented from being rubbed or spoiled.

A pen warm-up section 61 is provided on the upper surface of the lower machine casing 11 beside the finger receiving section 31 (i.e., at the position corresponding to the medium insertion/output opening 24 of the case body 2, which is on the left side in FIG. 1 in this embodiment). The pen warm-up section 61 is provided for pens 41 (described later) to perform drawing for warm-up (or preparation for smooth drawing) within the region on which the drawing head 42 (described later) makes drawings.

The pen warm-up section 61 is formed by making part of the upper surface of the lower machine casing 11 depressed. Preferably, the pen warm-up section 61 is substantially the same level as the nail T of a printing finger U1 inserted in the finger receiving section 31.

The pen warm-up section 61 is a flat part on which a drawing medium (not shown) inserted through the medium insertion/output opening 24 of the case body 2 is placed.

Anything that enables warm-up (breaking-in) of pen tips 412 may be used as a drawing medium to be placed on the pen warm-up section 61. For example, a slip of paper may be used.

The pen warm-up section 61 is used for warm-up drawing to bring pen tips 412 in good condition before the start of image drawing based on image data on a nail T. Specifically, in the warm-up drawing, a pen 41 is carried down to a drawing medium to draw predetermined figures, such as "○" and "∞". This prevents fuzzy lines at the beginning of the drawing due to drying of a pen tip 412 or a bad spread of ink.

The predetermined figure to be drawn for the warm-up drawing is not particularly limited, but preferably is a simple figure such as "○" and "∞" so as not to waste ink.

The figure, such as "○" and "∞", is preferably drawn at a position shifted a little each time within the range of the pen warm-up section 61.

When almost the entire drawing medium is filled with the preliminarily drawn figures, the display unit 26 displays on the screen a message demanding replacement of a drawing medium, such as "replace paper". A user then takes the drawing medium out through the medium insertion/output opening 24 to replace it with a new one to allow warm-up drawing on a new drawing medium.

The drawing medium may be a roll of paper, for example. In this case, when there is no more space for drawing, the drawing medium of the roll paper is pulled out and warm-up drawing can be made on a new surface.

In this embodiment, pen caps 62 made of rubber, for example, are disposed in front of the pen warm-up section 61 (i.e., at the near side in the finger insertion direction).

The number of the pen caps 62 is the same as the number of the pens 41 attached to the drawing unit 40. In this embodiment, the number is four. When the pens 41 attached to the drawing unit 40 do not perform drawing, the pens 41 are moved to the positions above the pen caps 62, are carried down with solenoids 435 (described later) pulled, and the pen tips 412 are fitted in the pen caps 62. This prevents the pen tips 412 from drying at a non-drawing time.

The shape and other features of the pen caps 62 are not limited to those described in the drawings. For example, a groove-like pen cap to receive the pen tips 412 of all the pens 41 attached to the drawing unit 40 may also be used.

In this embodiment, the pen caps 62 are disposed beside the pen warm-up section 61 as described above. In starting the drawing, the pens 41 are lifted and perform warm-up drawing on the close-by pen warm-up section 61, and then, regular drawing starts.

This minimizes the time required for the movement of the pens 41 and enables quick drawing.

The drawing unit 40 includes the drawing head 42 including the pens 41 for drawing, a unit support member 44 to support the drawing head 42, the X-direction movement stage 45 to move the drawing head 42 in the X direction (i.e., the X direction in FIG. 1 or the right-left direction of the nail printing apparatus 1), an X-direction movement motor 46, the Y-direction movement stage 47 to move the drawing head 42 in the Y direction (i.e., the Y direction in FIG. 2 or the front-back direction of the nail printing apparatus 1), and a Y-direction movement motor 48.

In this embodiment, the drawing head 42 has four pen carriages 43 to hold the respective pens 41.

Figure 4B:
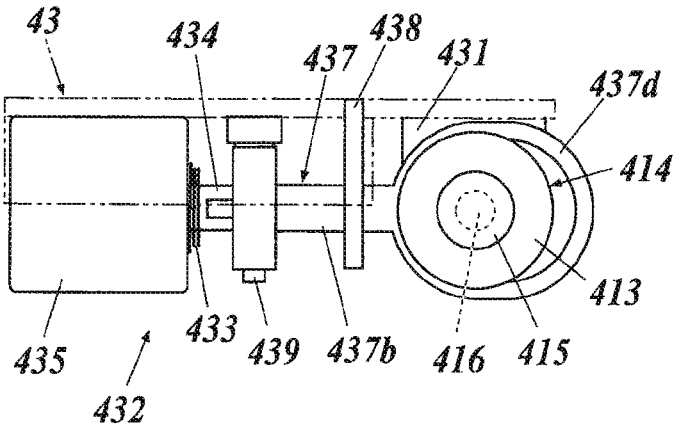
FIGS. 4A-4C are enlarged views of a pen carriage and a pen held by the pen carriage in a drawing state, and more specifically.
Figure 4A:
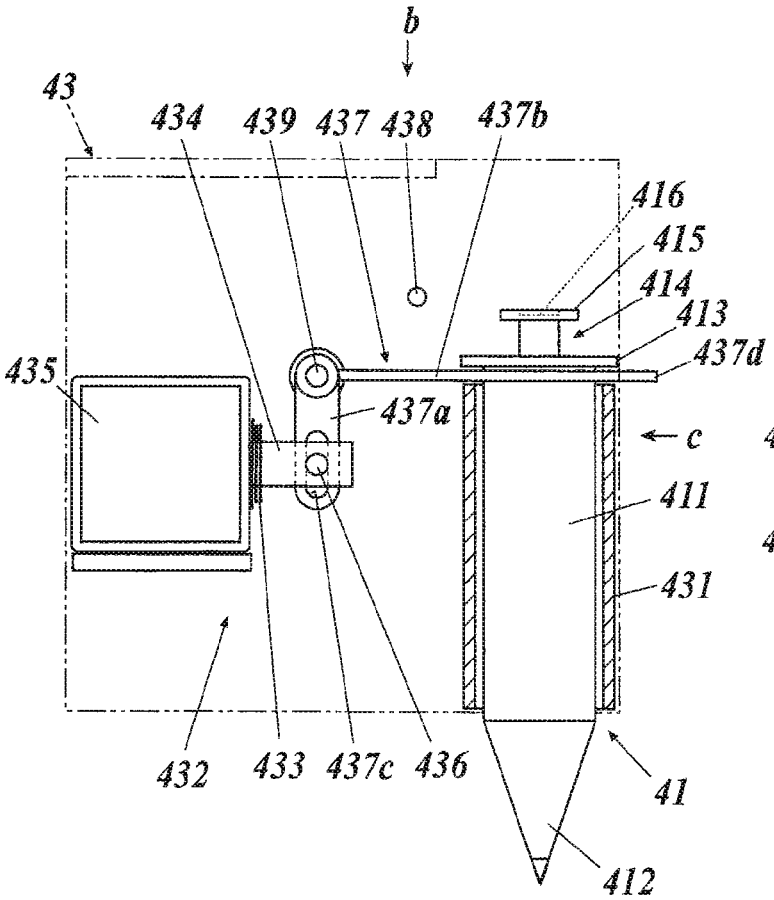
Figure 4C:
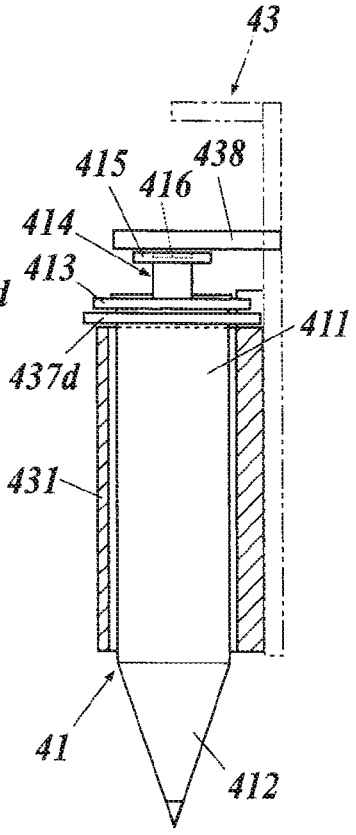

FIGS. 4A-4C are enlarged views of a pen carriage 43 and a pen 41 held by the pen carriage 43. FIGS. 4A-4C show a state in which a pen tip 412 is in contact with a nail T to perform drawing on the nail T (i.e., a drawing state), as in FIGS. 3A and 3B.

FIG. 4A is a side view of a pen carriage 43 and pen 41.

FIG. 4B is a top view obtained by viewing the pen carriage 43 and pen 41 of FIG. 4A from the arrow b.

FIG. 4C is a front view obtained by viewing the pen carriage 43 and pen 41 of FIG. 4A from the arrow c.

As shown in FIGS. 4A-4C, the pen 41 held by each pen carriage 43 has a pen shaft 411 and a pen tip 412 disposed at an end of the pen shaft 411.

The interiors of the pen shafts 411 serve as ink containers to contain various types of ink.

The viscosity and particle diameter (or particle size) of coloring material of the ink contained in the pen shafts 411 are not particularly limited. For example, ink containing gold and silver glitter, white ink, UV-curable ink, material for gel nails, undercoats, topcoats, and nail polish may be used as the ink.

A lid 414 is attached to the other end of each pen shaft 411. The lid 414 is provided with a flange 413 protruding outward from the pen shaft 411.

The pen shaft 411 and the lid 414 are preferably made of resin for reduction in weight of a pen 41, but the material for the pen shaft 411 and the lid 414 is not particularly limited.

In this embodiment, the lid 414 is provided with a tab 415 at its upper part to be pinched with fingers or tweezers easily.

A small piece of iron 416 is embedded in or adheres to the tab 415 to be attached to a magnet.

Each pen 41 has a pen tip 412 of a ballpoint-pen type, for example, which allows the ink in the pen shaft 411 to come out through the pen tip 412 pressed against the surface of a nail T for drawing.

The pen 41 is not limited to such a ballpoint-pen type, but may be a fiber-pen type which allows the ink to ooze through the felt pen tip for drawing, and a brush-pencil type which has a bundle of hair and performs drawing with the hair soaked with the ink.

The pen tips 412 may have various shapes and thicknesses.

The types of the pen tips 412 of the pens held by the pen carriages 43 may be the same as or different from one another.

Each pen 41 is held by a pen supporting part 437*d* and a pen holder 431 of a pen carriage 43, with the pen 41 just inserted into the pen supporting part 437*d* and the pen holder 431 from above, as described later. The pen 41 thus can be easily taken out to be replaced by opening the cover 23 for pen replacement of the case body 2 and pinching the tab 415 with fingers or tweezers or bringing a stick (not shown) with a magnet at its tip close to the tab 415 for the magnet to attract the iron piece 416 to pull the pen 41 up. A user thus can replace the pens 41 attached to the pen carriages 43 with other pens having various types of pen tips 412 and inks as appropriate in accordance with a nail design to be drawn, achieving a wide variety of nail designs.

In this embodiment, four pen carriages 43 each holding a pen 41 are arranged in the width direction of the apparatus (i.e., the right-left direction or the X direction in FIG. 1). Accordingly, the positions of the pen tips 412 of the pens 41 are different from one another in the X direction (or the right-left direction of the apparatus). The amount of difference in position is equal to the integral multiple of one step of the drawing operation. Correction is made by the number of steps corresponding to the difference in position of the pens 41 in accordance with the pens 41 to be used for drawing. The four pens 41, therefore, can make drawings at the same position.

Each of the pen carriages 43 includes a pen holder 431 to hold a pen 41 substantially vertically, and a pen up-and-down mechanism 432 to carry the pen 41 up and down.

The pen holder 431 is a cylindrical portion into which the pen tip 412 and the pen shaft 411 are inserted to hold the pen 41.

The pen up-and-down mechanism 432 is biased forward by a spring 433 (i.e., rightward in FIGS. 2 and 4A) and includes a cylindrical plunger 434 to move back and forth like a piston, a solenoid 435 (which may be a push solenoid in which a magnetic body is pushed out from a coil or a pull solenoid in which a coil draws a magnetic body thereinto) to keep the plunger 434 rearward (i.e., leftward in FIGS. 2 and 4A) against the biasing force of the spring 433, a lever support shaft 436 attached to the moving end part of the plunger 434, a pen up-and-down lever 437 connected to the plunger 434 through the lever support shaft 436 and rotatable about the rotation axis 439, and a fixed stopper 438 to regulate the upper limit of the rotation angle of the pen up-and-down lever 437 rotating upward.

As shown in FIG. 4A, the pen up-and-down lever 437 is an L-shaped member having a short arm 437*a* and a long arm 437*b* substantially perpendicular to each other. The short arm 437*a* has a long hole 437*c* at its end part. The long hole 437*c* is engaged with the lever support shaft 436.

The long arm 437*b* has a pen supporting part 437*d* at its end part into which a pen 41 is to be inserted.

The pen supporting part 437*d* is in the shape of a ring having an inner diameter larger than those of the pen shaft 411 and pen tip 412 of the pen 41, and smaller than that of the flange 413 of the pen 41. The pen shaft 411 and pen tip 412 are inserted into the pen supporting part 437*d*, and the pen supporting part 437*d* catches the flange 413 so as to support the flange 413 from below.

The rotation axis 439 fixed to the pen carriage 43 side is inserted in the intersection of the short arm 437*a* and the long arm 437*b* of the pen up-and-down lever 437.

In this embodiment, when the solenoid 435 is being driven, the plunger 434 is pulled rearward against the biasing force of the spring 433 as shown in FIG. 4A. At this time, the pen up-and-down lever 437 engaged with the lever support shaft 436 of the plunger 434 is kept in such a way that the long arm 437*b* is almost horizontally positioned.

In this state, the tip of the pen 41 is below the pen holder 431 of the pen carriage 43 and can touch the surface of a nail T or a drawing medium, which is a drawing state.

When the solenoid 435 is off, the biasing force of the spring 433 pushes the plunger 434 forward. At this time, the pen up-and-down lever 437 engaged with the lever support shaft 436 of the plunger 434 rotates upward (i.e., in the counter-clockwise direction) with the rotation axis 439 as a pivot point until the long arm 437*b* touches the stopper 438.

In this way, the pen up-and-down lever 437 brings the flange 413 of the pen 41 upward (see FIG. 2). In this state, the tip of the pen 41 is above the pen holder 431 of the pen carriage 43 and does not touch the surface of a nail T or a drawing medium, which is a non-drawing state.

In this way, the force to move the plunger 434 back and forth produced by the solenoid 435 is converted to the force to move the pen 41 up and down through the rotation axis 439 and the pen up-and-down lever 437 to rotate about the rotation axis 439.

The pen 41 is just inserted in the pen holder 431 of the pen carriage 43 but is not fixed to the pen up-and-down lever 437 etc. This allows the pen 41 to be biased downward for its own weight.

The pen 41 thus can freely go down the pen holder 431 until the flange 413 comes into contact with the upper surface of the pen supporting part 437*d*, and when the pen tip 412 touches the surface of a nail T or a drawing medium, the pen tip 412 presses the surface of the nail T or the drawing medium by its own weight.

In other words, when the pen 41 makes a drawing on a nail T, the pen tip 412 can freely move in the Z direction (i.e., vertical direction) perpendicular to the X-Y plane, on which a printing finger U1 is placed, along the shape (ups and downs) of the surface of the nail T in accordance with the curve and height of the nail T.

For example, when a drawing is to be made on a low area of a nail T (for example, the both-end parts of a nail T in its width direction), a pen 41 comes down almost to such a position as the flange 413 touches the upper surface of the pen supporting part 437*d*. On the other hand, when a drawing is to be made on a high area of a nail T (for example, the center part of a nail T in its width direction), a pen 41 goes up in accordance with the level of the nail T and the flange 413 goes away from the upper surface of the pen supporting part 437*d*.

The pen 41 is very light in weight, e.g., several tens of grams, and a user does not feel a pain when a pen tip 412 touches a nail T. The weight of the pen 41, however, applies an enough pen pressure, enabling production of excellent nail designs on nails T.

In this embodiment, the rotation axis 439 and the stopper 438 are made of metal, such as stainless-steel; and the other members constituting the pen up-and-down mechanism 432 are made of material, such as resin, which is light in weight and does not react with a magnet.

The materials of the members constituting the pen up-and-down mechanism 432 are not limited to those shown above.

The solenoids 435 are used as actuators to move the pens 41 up and down in this embodiment. The actuators to move the pens 41 up and down, however, are not limited to the solenoids 435. Since the pens 41 are light in weight, the actuators to move the pens 41 up and down may be constituted of various types of compact driving devices, instead of the solenoids.

The unit support member 44 supporting the drawing head 42 is fixed to an X-direction movement section 451 attached to the X-direction movement stage 45.

The X-direction movement motor 46 drives the X-direction movement section 451 to move in the X direction along a guide (not shown) on the X-direction movement stage 45. This allows the drawing head 42 to move in the X direction (i.e., the X direction in FIG. 1 or the right-left direction of the nail printing apparatus 1).

The X-direction movement stage 45 is fixed to the Y-direction movement section 471 of the Y-direction movement stage 47.

The Y-direction movement motor 48 drives the Y-direction movement section 471 to move in the Y direction along a guide (not shown) on the Y-direction movement stage 47. This allows the drawing head 42 to move in the Y direction (i.e., the Y direction in FIG. 2 or the front-back direction of the nail printing apparatus 1).

In this embodiment, the X-direction movement stage 45 and the Y-direction movement stage 47 are constituted of the combination of the X-direction movement motor 46, the Y-direction movement motor 48, ball screws (not shown), and guides (not shown).

In this embodiment, the X-direction movement motor 46, the Y-direction movement motor 48 and the like constitute a head drive section 49 as an X-Y drive section to drive the drawing head 42 including the pens 41 to make drawings on nails T in the X and Y directions.

The solenoids 435, the X-direction movement motor 46, and the Y-direction movement motor 48 to move the pens 41 of the drawing unit 40 up and down are connected to a drawing controller 815 of a control device 80 (see FIG. 5, described later) to be controlled by the drawing controller 815.

In this embodiment, the drawing controller 815 adjusts the movement of the drawing head 42, to which the pens 41 are attached, in accordance with the inclination angle of the surface of a nail T as a target of drawing, as described later.

As shown in FIGS. 1 and 2, the photographing unit 50 is disposed on the upper machine casing 12.

A substrate 13 is disposed on the upper machine casing 12, and two cameras 51 as photographing devices are disposed at the center of the lower surface of the substrate 13.

The cameras 51 preferably have about two million pixels or more.

The cameras 51 photograph the nail T of a printing finger U1 inserted in the finger receiving section 31 to obtain nail images (i.e., finger images each including the image of the nail T), which are the images of the nail T of the printing finger U1.

In this embodiment, the two cameras 51 are arranged substantially side by side in the width direction of the nail T of a printing finger U1 inserted in the finger receiving section 31.

One of the two cameras 51 faces the bottom face of the finger receiving section 31 to photograph a nail T from just above.

The other of the two cameras 51 is slightly tilted with respect to the bottom face of the finger receiving section 31 according to the curvature of a nail T to photograph the nail T from diagonally above.

The substrate 13 is provided with illuminators (illuminating devices) 52, such as white LEDs, disposed in such a way as to surround the cameras 51.

The illuminators 52 illuminate the nail T of a printing finger U1 at the time of the photographing by the cameras 51. The photographing unit 50 is constituted of the cameras 51 and the illuminators 52.

The photographing unit 50 is connected to a photographing controller 811 of the control device 80 (see FIG. 5, described later) to be controlled by the photographing controller 811.

The image data of images obtained by the photographing unit 50 is stored in a nail image storage area 821 of a storage unit 82, described later.

In this embodiment, two cameras 51 as photographing devices photograph a nail T from at least two different positions or angles to obtain at least two nail images.

A nail information detecting section 812 (described later) detects nail information, such as the contour (shape) of a nail T and the vertical position of a nail T, on the basis of the nail images.

An inclination angle detector 812*a* can detect the inclination angle of the surface of a nail T with respect to the X-Y plane (hereinafter referred to as "inclination angle of a nail T" or "nail curvature") on the basis of the nail images.

Taking the images of a nail T from just above and from diagonally above the nail T enables accurate detection of the inclination angle of the surface of the nail T as well as the contour of the nail T.

The inclination angle of a nail T is the angle θ shown in FIG. 3B. A counterclockwise angle θ is a plus angle, and a clockwise angle θ is a minus angle.

The control device 80 is disposed on the substrate 13 on the upper machine casing 12, for example.

Figure 5:
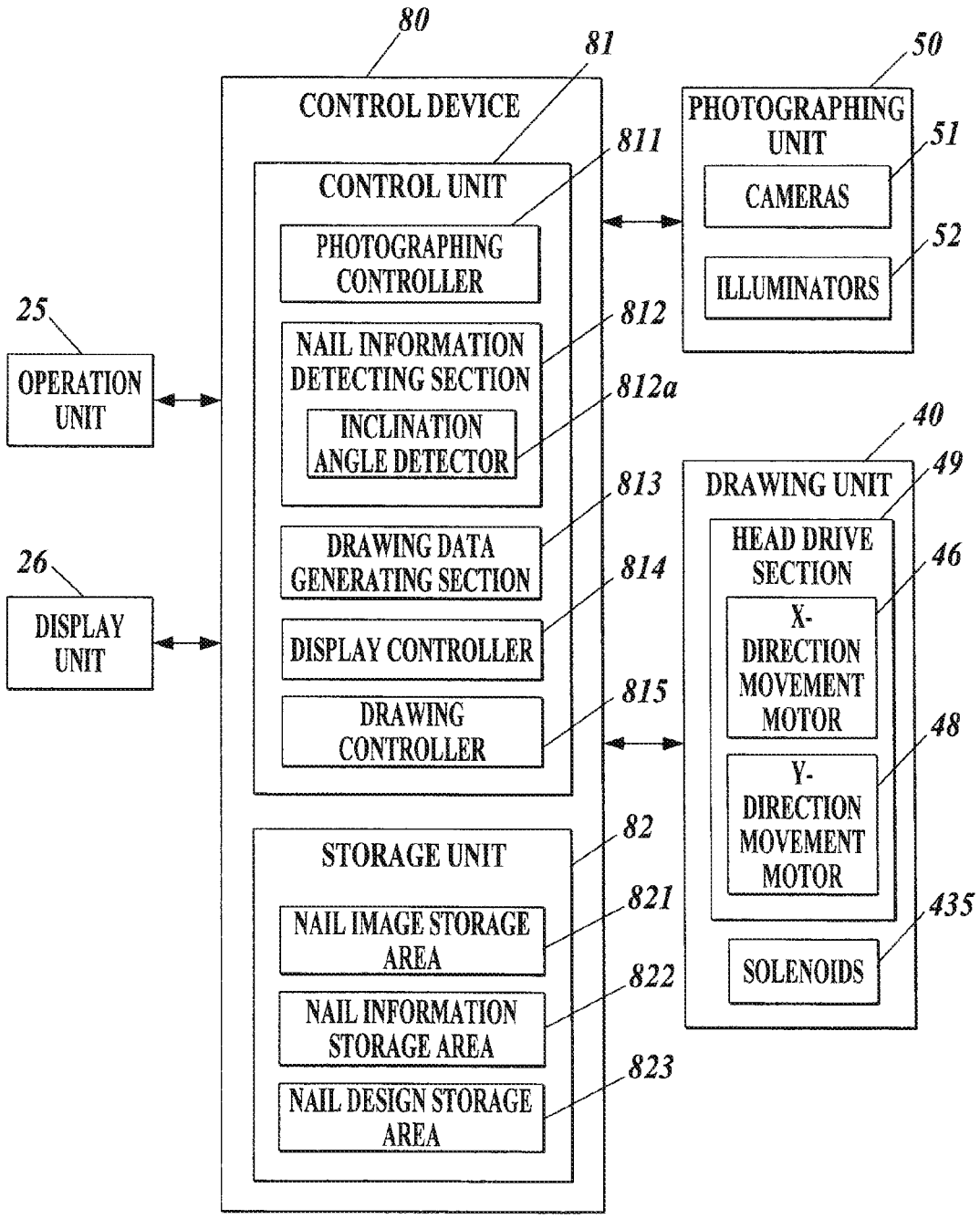
FIG. 5 is a block diagram showing the principal control configuration of the nail printing apparatus according to this embodiment.

FIG. 5 is a block diagram showing the principal control configuration in this embodiment.

As shown in FIG. 5, the control device 80 is a computer including a control unit 81 constituted of a central processing unit (CPU), and a storage unit 82 constituted of a read only memory (ROM) and a random access memory (RAM), for example (the CPU, ROM and RAM are not shown).

The storage unit 82 contains various programs and various pieces of data for the operation of the nail printing apparatus 1.

Specifically, the ROM of the storage unit 82 contains various programs, such as a nail information detection program to detect nail information such as the shape and the inclination angle of a nail T from nail images; a drawing data generation program to generate drawing data; and a drawing program to perform drawing processing. Each unit of the nail printing apparatus 1 is comprehensively controlled through the execution of these programs by the control device 80.

In this embodiment, the storage unit 82 includes a nail image storage area 821, a nail information storage area 822, and a nail design storage area 823. The nail image storage area 821 stores nail images of the nail T of a user's printing finger U1 obtained by the photographing unit 50. The nail information storage area 822 stores the nail information detected by the nail information detecting section 812 (including the inclination angle detector 812*a*). The nail design storage area 823 stores the image data of nail designs to be drawn on nails T.

In this embodiment, information to prescribe the processing to be performed at the time of drawing is added to the image data of nail designs stored in the nail design storage area 823. The information includes the information indicating a part for which a drawing processing for fill is to be performed in a nail design, and a part which is to be drawn as a series of figure in a nail design.

A part which is to be drawn as a series of figure means a small figure portion for which the moving distance of a pen 41 in the width direction of a nail T at the time of drawing is only smaller than a predetermined limit value. Examples of such parts include a ring figure having a diameter of less than 1 mm.

The predetermined limit value may be set to about 0.8 mm-1.2 mm, but is not limited to this. The predetermined limit value may be determined appropriately depending on the kind of figure and/or the thickness of lines to be drawn.

A series of figure portion in which gaps and discontinuity would easily be noticed, as a design, may be dealt with as a part to be drawn as a series of figure, regardless of the moving distance of a pen 41 in the width direction of a nail T for drawing.

For the area of a series of figure for which the moving distance of a pen 41 in the width direction of a nail T at the time of drawing is smaller than a predetermined limit value, the figure is drawn as a series of continuous figure without the application of the drawing direction limiting processing by the drawing controller 815 (described later) even when part of or all of the figure falls on a steeply-inclined area (described later).

The control unit 81 includes the photographing controller 811, the nail information detecting section 812, the drawing data generating section 813, the display controller 814, and the drawing controller 815, in terms of its function.

The functions as the photographing controller 811, the nail information detecting section 812, the drawing data generating section 813, the display controller 814, and the drawing controller 815 are carried out through cooperation between the CPU of the control unit 81 and the programs stored in the ROM of the storage unit 82.

The photographing controller 811 controls the cameras 51 and the illuminators 52 of the photographing unit 50 so that each camera 51 takes a finger image including the image of the nail T of a printing finger U1 inserted in the finger receiving section 31 (hereinafter referred to as a "nail image").

In this embodiment, the photographing controller 811 allows the two cameras 51 to obtain at least two nail images from different positions or angles (e.g., from just above a nail T and diagonally above the nail T).

The image data of nail images obtained by the photographing unit 50 may be stored in the storage unit 82.

The nail information detecting section 812 detects the nail information on the nail T of a printing finger U1 on the basis of the images of the nail T of the printing finger U1 inserted in the finger receiving section 31 obtained by the cameras 51.

In this embodiment, the nail information detecting section 812 includes the inclination angle detector 812*a* to detect the inclination angle of a nail T.

The nail information includes the information on the contour of a nail T (i.e., the shape and the horizontal position of a nail T), the height of a nail T (i.e., the position of a nail T in the vertical direction; hereinafter referred to as "vertical position of a nail T" or simply as "the position of a nail T"), and the inclination angle of the surface of a nail T with respect to the X-Y plane (i.e., the inclination angle of a nail T or nail curvature).

The inclination angle of a nail T (or nail curvature) refers to the angle with respect to the horizontal plane in the width direction of the nail T (i.e., with respect to the X-Y plane of the finger placement section 116*a* on which the printing finger U1 is placed). The inclination angle is the angle θ shown in FIG. 3B.

In this embodiment, the nail information detecting section 812 including the inclination angle detector 812*a* detects the contour of a nail T (nail shape) and the inclination angle of a nail T (nail curvature) on the basis of nail images among the nail information.

Specifically, the nail information detecting section 812 detects the contour (shape and size) and position of the nail T from the images of the nail T of a printing finger U1 obtained by the cameras 51. Thus, the contour is acquired as the information represented by an X-Y coordinate, for example.

For example, the nail information detecting section 812 may detect the contour (shape) of a nail T on the basis of the difference in color between the nail T and the other part of the finger, from the nail images of the nail T of the printing finger U1 obtained by the cameras 51.

The method to detect the contour (shape) of a nail T is not limited to the example shown here, but the nail information detecting section 812 may employ any other method.

The inclination angle detector 812*a* detects the inclination angle of a nail T (nail curvature) on the basis of at least two nail images obtained by the two cameras 51.

The inclination angle detector 812*a* detects the inclination angle (curvature) of a user's nail T from the difference in shading between the two nail images taken by the two cameras 51 from different positions or angles (e.g., from just above and diagonally above the nail T).

The method to detect the inclination angle of a nail T (nail curvature) is not limited to the example shown here, but the nail information detecting section 812 may employ any other method.

The drawing data generating section 813 generates data to be drawn on the nail T of a printing finger U1 by the drawing head 42 on the basis of the nail information detected by the nail information detecting section 812.

Specifically, the drawing data generating section 813 performs a fitting process such as expansion or reduction in size or clipping of image data of a nail design on the basis of the shape of a nail T detected by the nail information detecting section 812 to generate data to be drawn on the nail T.

In this embodiment, the drawing data generating section 813 performs curved surface correction on image data of nail design in accordance with the inclination angle of a nail T (nail curvature) detected by the inclination angle detector 812*a*.

The display controller 814 controls the display unit 26 to display various screens on the display unit 26.

In this embodiment, the display controller 814 controls the display unit 26 to display a selection screen to allow selection of a nail design, a thumbnail image for confirmation of a design, nail images obtained by photographing of a printing finger U1, various types of instruction screens, and the like.

The drawing controller 815 outputs drawing data generated by the drawing data generating section 813 to the drawing unit 40 and controls the solenoids 435, the X-direction movement motor 46, and the Y-direction movement motor 48 of the drawing unit 40 to make a drawing based on the drawing data on a nail T.

In this embodiment, the drawing controller 815 can move the pens 41 in any direction regardless of the direction of the inclination of the surface of a nail T detected by the inclination angle detector 812*a* for an area in which the absolute value of the inclination angle is less than a predetermined threshold angle θt.

On the other hand, for an area (i.e., a "steeply-inclined area" described later) in which the absolute value of the inclination angle in the width direction of the surface of a nail T, which is detected by the inclination angle detector 812*a*, is equal to or larger than the predetermined threshold angle θt, the drawing controller 815 controls the X-Y drive section (i.e., the X-direction movement motor 46 and the Y-direction movement motor 48 constituting the head drive section 49) so as to perform drawing direction limiting processing. In the drawing direction limiting processing, a pen 41 is allowed to move from high to low above the X-Y plane of a nail T (or above the finger placement section 116*a*), but the pen 41 is prohibited from moving from low to high.

The threshold value et of the inclination angle may be set appropriately, and an optimum value varies depending on the type or form etc. of a pen 41. It has been experimentally found that the threshold value of about 40°-50° is preferred. In this embodiment, the threshold value is set to 45°, for example.

The problems which occur when a pen 41 is moved for drawing from an end part of a nail T, the height of which is relatively low, to the center part of the nail T, the height of which is relatively high (i.e., when a pen 41 performs drawing while moving up the inclined surface of the nail T), are now described. Further, the case in which a pen 41 moves down the inclined surface of a nail T is also described.

When a pen 41 moves up the inclined surface of a nail T, the pen 41 applies a force pressing the nail T in the horizontal direction. This force may strongly push the nail T in the horizontal direction and may cause the printing finger U1 to move, resulting in deterioration in quality of the finish of the nail print.

FIGS. 6A-6E explain the relationship between the inclination angle of a nail and the pressing force applied to the nail.

Figure 6A:
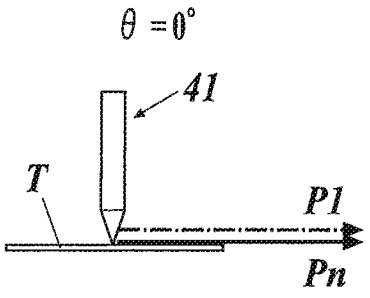
FIGS. 6A-6E explain the relationship between the inclination angle of a nail and the force of pressing the nail, and more specifically.

When a horizontal force Pn is applied to a pen 41 and moves the pen 41 rightward as shown in FIG. 6A, and when the angle θ (or the inclination angle) of the surface of a nail T with respect to the X-Y plane on which the printing finger U1 is placed is 0°, all the force Pn from the pen 41 is the horizontal component P1 of force to the nail T, and the only vertical pressing force applied to the nail T is the pen's own weight.

In FIGS. 6A-6E, the force applied to the nail T due to the weight of the pen 41 is not shown for sake of simplicity.

Figure 6B:
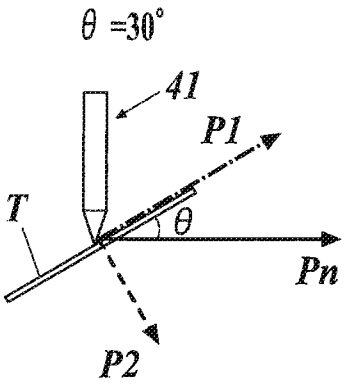

When the inclination angle θ of a nail T is 30° as shown in FIG. 6B, half (sin 30°=0.50) of the force Pn from the pen 41 is the vertical component P2 of force pressing the inclined surface of the nail T in the direction perpendicular to the inclination surface.

Figure 6C:
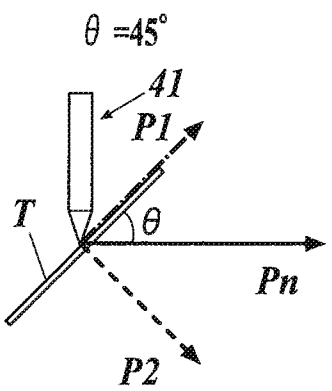

When the inclination angle θ of a nail T is 45° as shown in FIG. 6C, about 70% (sin 45°=0.7071) of the force Pn from the pen 41 is the vertical component P2 of force pressing the inclined surface of the nail T in the direction perpendicular to the inclination surface.

Figure 6D:
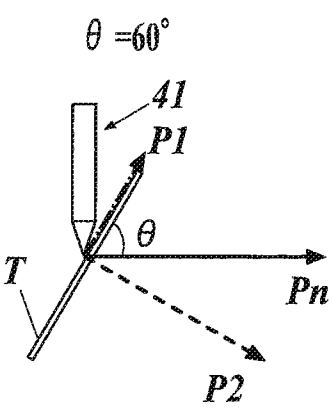

When the inclination angle θ of a nail T is 60° as shown in FIG. 6D, sin 60° (=0.8660) of the force Pn from the pen 41 is the vertical component P2 of force pressing the inclined surface of the nail T in the direction perpendicular to the inclination surface, that is, over 80% of the force Pn from the pen 41 is applied to the nail T.

With an increase in inclination angle θ of a nail T, the vertical component P2 of force vertically pressing the inclined surface of the nail T increases. This increase the force pressing the nail T in the horizontal direction caused by the vertical component P2 of force. This causes the printing finger U1 to move.

Figure 6E:
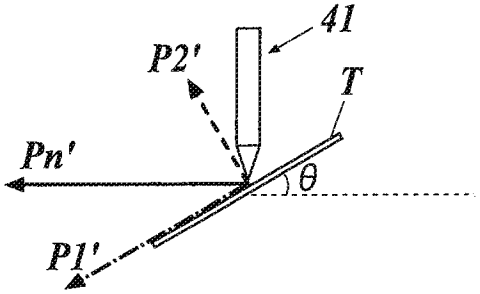

FIG. 6E shows the case in which a pen 41 moves down the inclined surface of a nail T for drawing.

When the horizontal force Pn' is applies to the pen 41 and moves the pen 41 leftward in FIG. 6E, the force Pn' does not generate a component of force vertically pressing the inclined surface of the nail T regardless of the inclination angle θ of the nail T. At this time, the force vertically pressing the nail T is only the weight of the pen 41, and the pen 41 slides down the inclined surface of the nail T by only the pen's own weight.

Accordingly, when a pen 41 performs a drawing while moving down the inclined surface of a nail T, the printing finger U1 is not caused to move regardless of the inclination angle θ of the nail T.

Figure 7:
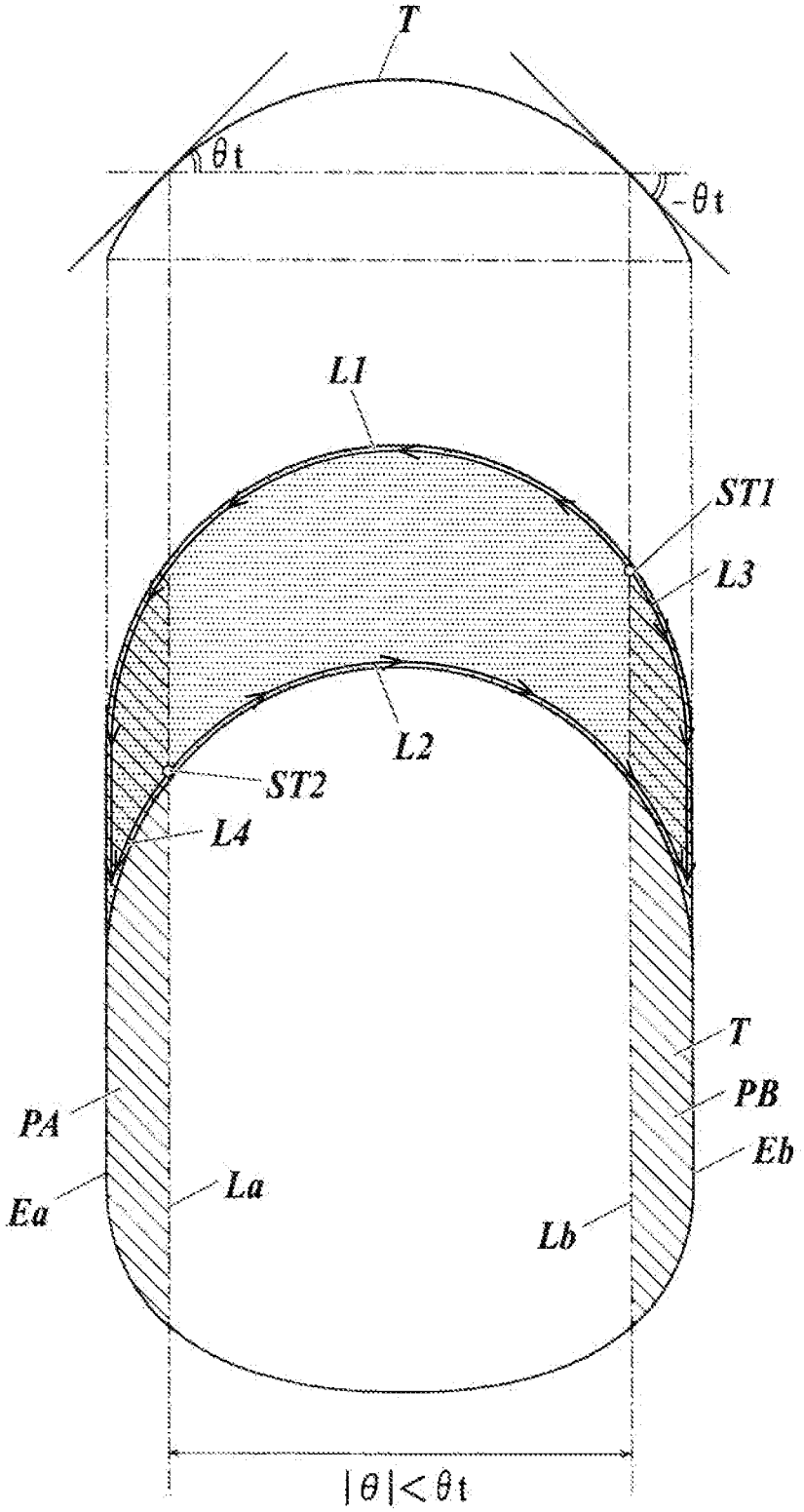
FIG. 7 explains the procedure of drawing the contour of a fill area.

FIG. 7 explains the procedure to draw the contour of a fill area.

Figure 8:
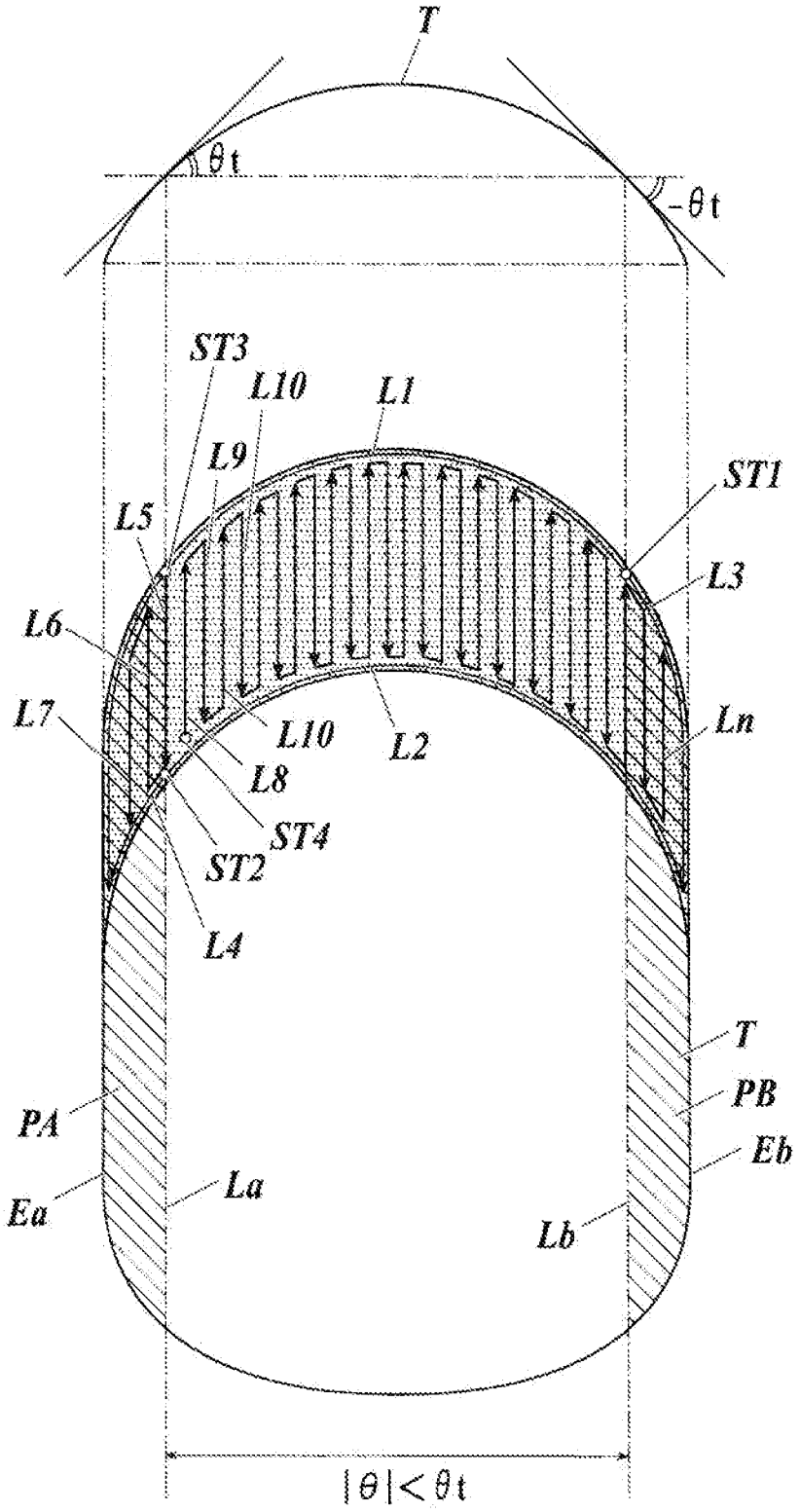
FIG. 8 explains filling processing to fill a fill area.

FIG. 8 explains the procedure of filling processing to fill a fill area.

Figure 9:
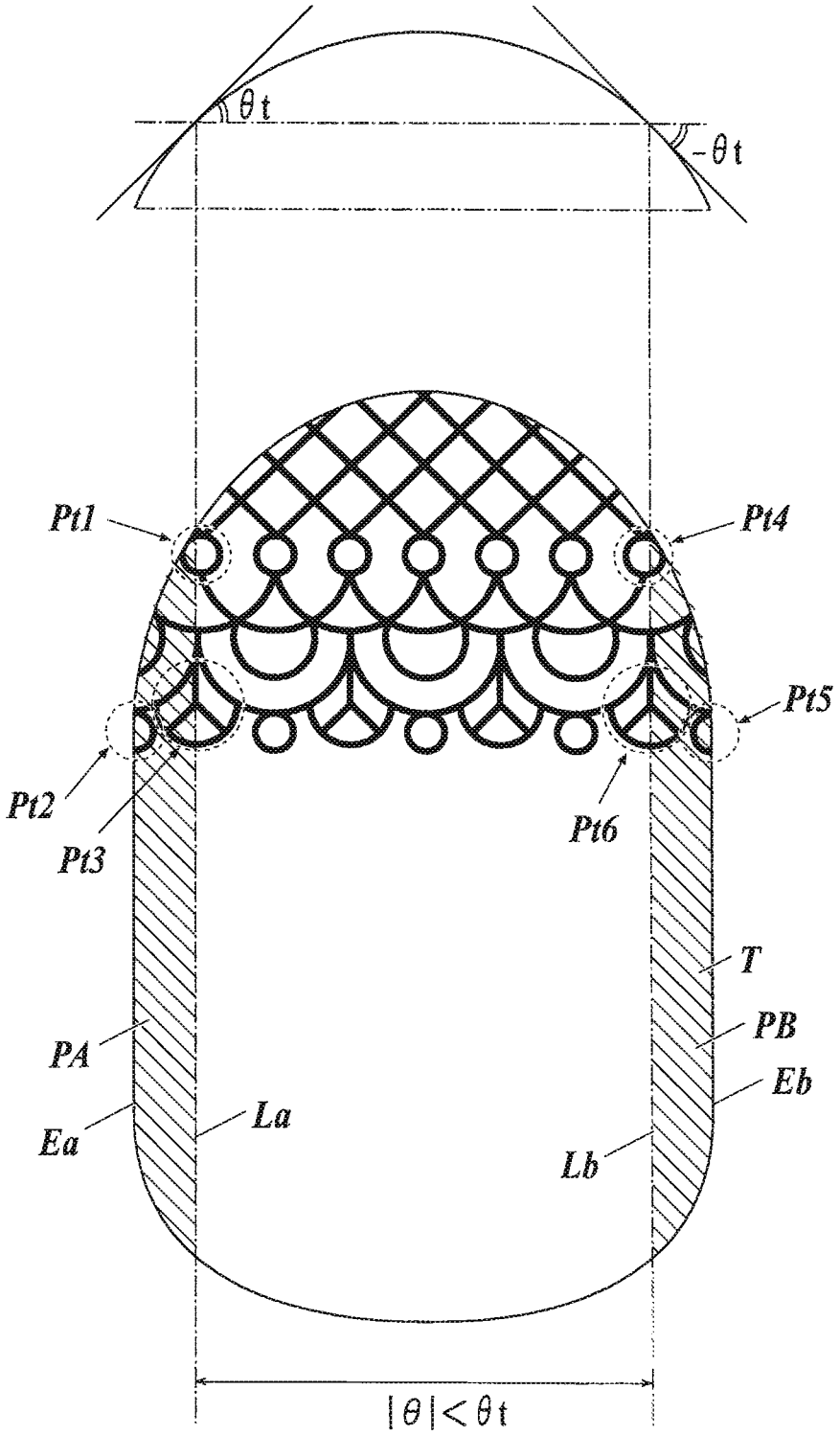
FIG. 9 shows an example of a nail with a nail design of lace pattern on its tip part.

FIG. 9 shows an example of a nail with a nail design of lace pattern on its tip part.

A steeply-inclined area PA shown in FIGS. 7-9 is an area enclosed by the left edge Ea of the nail T and the boundary La where the inclination angle θ is a threshold angle (θt). A steeply-inclined area PB shown in FIGS. 7-9 is an area enclosed by the right edge Eb of the nail T and the boundary Lb where the inclination angle θ is a threshold angle (−θt).

In this embodiment, the drawing controller 815 performs drawing direction limiting processing in the steeply-inclined areas PA and PB shown in FIGS. 7-9. In the drawing direction limiting processing, the drawing controller 815 does not allow a pen 41 to move up the inclined surface of a nail T from low to high along the nail T but allows the pen 41 to move from high to low as shown in FIG. 6E.

This prevents the nail T from being pushed in the horizontal direction by a pen 41, preventing the printing finger U1 from being moved during the drawing.

Specific control for drawing performed by the drawing controller 815 is now be described with reference to FIGS. 7-9.

In general, the widthwise center part of a nail T is at a high position, and the level gets lower and the inclination angle in the width direction of the nail T gets larger as going toward a widthwise end of the nail T. In the embodiment, an example is described in which the drawing direction limiting processing is performed when a pen 41 draws lines while moving in the width direction of a nail T.

A nail T may have various shapes. In some nails T, the lengthwise center part may be at a high position, and the level may get lower and the inclination angle in the length direction of the nail T gets larger as going toward a lengthwise end of the nail T.

In light of this, the drawing direction limiting processing may be performed when a pen 41 draws lines while moving in the length direction, as well as in the width direction of a nail T.

FIGS. 7 and 8 show examples of formation of French nail, application of color to the tip part of a nail T.

French nail is formed by setting a tip part of a nail T as a predetermined fill area (i.e., the shaded area in FIGS. 7 and 8), and filling the fill area.

To form French nail, the drawing controller 815 moves a pen 41 in the width direction of the nail T, and performs contour drawing processing to draw the contour of the fill area, as shown in FIG. 7.

The pen 41 can move in any direction for drawing without limitation for the area in which the absolute value of the inclination angle of the surface of the nail T is less than a threshold angle (et) (i.e., the center part of the nail T in its width direction in FIG. 7). The drawing controller 815 moves the pen 41 for drawing in an economical manner.

On the other hand, for the area in which the absolute value of the inclination angle of the surface of the nail T is equal to or larger than a threshold angle (θt) (i.e., for the steeply-inclined areas PA and PB), the drawing controller 815 applies the drawing direction limiting processing. In the drawing direction limiting processing, the pen 41 is allowed to move from high to low above the X-Y plane of the nail T (or above the finger placement section 116*a*), but the pen 41 is prohibited from moving from low to high.

Specifically, the contour (line L1 in FIG. 7) to define the upper edge of the fill area is drawn from the first start point ST1 to one side edge (left edge in FIG. 7) for the center part of the nail T in which the absolute value of the inclination angle θ of the nail surface is less than a threshold angle (θt) and for one of the side parts of the nail T, i.e., the steeply-inclined area PA (the left side part in FIG. 7).

Next, the contour (line L2 in FIG. 7) to define the lower edge of the fill area is drawn from the second start point ST2 to the other side edge (right edge in FIG. 7) for the center part of the nail T in which the absolute value of the inclination angle θ of the nail surface is less than the threshold angle (θt) and for the other of the side parts of the nail T, i.e., the steeply-inclined area PB (the right side part in FIG. 7).

Further, the rest of the contour (line L3 in FIG. 7) to define the upper edge of the fill area is drawn from the first start point ST1 to the opposite side edge (right edge in FIG. 7) for the steeply-inclined area PB.

Finally, the rest of the contour (line L4 in FIG. 7) to define the lower edge of the fill area is drawn from the second start point ST2 to the opposite side edge (left edge in FIG. 7) for the steeply-inclined area PA.

The contour to define the fill area is thus drawn.

The drawing order of the lines L1-L4 is not limited to the example shown above.

The drawing controller 815 subsequently controls the X-Y drive section (i.e., the X-direction movement motor 46, and the Y-direction movement motor 48) to perform drawing processing for fill in which drawing is performed with the pen 41 moved in the length direction of the nail T (or longitudinal direction in FIGS. 7 and 8) perpendicular to the width direction of the nail T (or lateral direction in FIGS. 7 and 8) within the area enclosed by the contour.

Specifically, as shown in FIG. 8, the drawing controller 815 performs the filling processing (lines L5-L7 in FIG. 8) for the steeply-inclined area PA of the surface of the nail T. The filling processing starts from the third start point ST3 and goes on from high to low along the nail T, i.e., from the center part to one side edge area of the nail T, while the pen 41 is moving back and forth in the length direction of the nail T.

The drawing controller 815 subsequently performs the filling processing (lines L8-Ln in FIG. 8) for the remaining area. The filling processing starts from the fourth start point ST4 and goes on from the area adjacent to the steeply-inclined area PA, on which the filling processing has already completed, to the other side edge area, while the pen 41 is moving back and forth in the length direction of the nail T.

In this embodiment, the drawing controller 815 does not perform the drawing direction limiting processing for a part to be drawn as a series of figure. Specifically, the drawing controller 815 controls the X-Y drive section (i.e., the X-direction movement motor 46 and the Y-direction movement motor 48 constituting the head drive section 49) to draw a relatively small figure as a series of continuous figure even if part of or all of the figure is to fall on a steeply-inclined area and even if the continuous drawing requires a pen 41 to move up some part of the steeply-inclined area.

If a figure to be drawn is a series of figure constituted of a very short line of about 0.8 mm to 1.2 mm, the drawing controller 815 can move a pen 41 from low to high above the X-Y plane of a nail T at the time of line drawing with a pen 41 moving in the width direction of the nail T for an area in which the inclination angle of the surface of the nail T detected by the inclination angle detector 812*a* is equal to or larger than a predetermined threshold angle (θt) (i.e., for the steeply-inclined areas PA and PB).

If the drawing direction limiting processing, in which a pen 41 is always moved from high to low of a nail T, is always applied, even to the case of drawing a fine figure requiring only a short moving distance of a pen 41, the figure has to be divided into some parts to be drawn. In such a case, the parts may not be smoothly connected to one another, leading to misalignment of the parts and failing to form a clear figure.

The following is the explanation for the case in which a nail design, such as a lace pattern as shown in FIG. 9, to be drawn on a nail T includes fine figures such as small ring figures, and in which the fine figures include a series of continuous fine figure to spread from low to high above the X-Y plane of a nail T (see Pt1-Pt6 in FIG. 9, for example).

Figure 10:
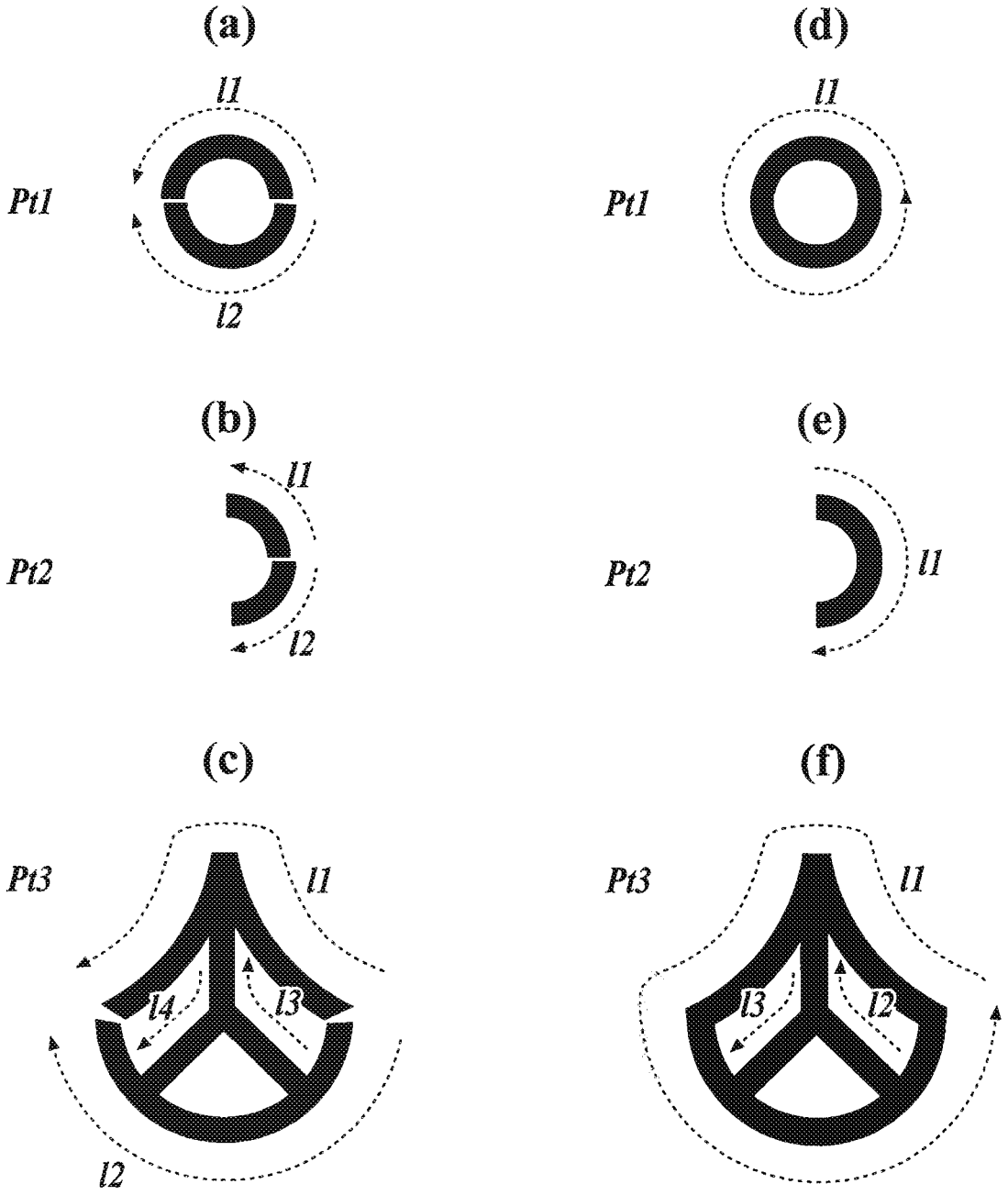
FIG. 10 (*a*) shows an example of the part Pt1 of FIG. 9 drawn with drawing direction limiting processing applied, FIG. 10(*b*) shows an example of the part Pt2 of FIG. 9 drawn with the drawing direction limiting processing applied, FIG. 10(*c*) shows an example of the part Pt3 of FIG. 9 drawn with the drawing direction limiting processing applied, FIG. 10 (*d*) shows an example of the part Pt1 of FIG. 9 drawn without the application of the drawing direction limiting processing, FIG. 10(*e*) shows an example of the part Pt2 of FIG. 9 drawn without the application of the drawing direction limiting processing, and FIG. 10(*f*) shows an example of the part Pt3 of FIG. 9 drawn without the application of the drawing direction limiting processing.

FIGS. 10 (*a*)-10(*c*) show the figures drawn with the drawing direction limiting processing applied, and FIGS. 10(*d*)-10(*f*) show the figures drawn without the application of the drawing direction limiting processing.

If these figures are to be drawn with the drawing direction limiting processing applied, each of the figures has to be divided into two or more parts for drawing, as indicated by the broken-line arrows in FIGS. 10(*a*)-10(*c*), for example. FIGS. 10(*a*), 10(*b*), and 10(*c*) show Pt1, Pt2, and Pt3, respectively, of FIG. 9 but are also applicable to Pt4, Pt 5, and Pt6 of FIG. 9, respectively.

In this case, lines are not exactly connected between the parts into which a figure is divided as shown in FIGS. 10(*a*)-10(*c*), leading to misalignment of the parts.

When each of the figures is drawn as a series of figure as indicated by the broken-line arrows in FIGS. 10(*d*)-10(*f*) without the application of the drawing direction limiting processing even if a pen 41 is to move partly from low to high along a nail T, misalignment of parts of each figure does not occur. Thus, beautiful finish is achieved.

When the moving distance of a pen 41, from low to high along a nail T, is short (e.g., in the case of drawing a part of a fine figure), a user does not feel that the nail is pressed by such a strong force. For this reason, the finger is not pushed and moved during the drawing of a series of figure.

In this case, the drawing controller 815 may control the head drive section 49 so as to reduce the movement speed of a pen 41 when the pen 41 moves up a nail T from low to high.

Such reduction in movement speed of a pen 41 reduces the workload per unit of time given from the pen 41 to the nail T compared to the case without such an adjustment of the movement speed. Further, the reduction in movement speed of a pen 41 allows the pen 41 to move up the inclined surface more easily.

In other words, the reduction in movement speed of a pen 41 reduces the horizontal force Pn applied to the pen 41 shown in FIGS. 6A-6D. This can reduce the feeling that the nail T is pressed with a pen 41 even when the pen 41 is moving from low to high along the nail T for drawing (i.e., moving up the inclination). This reduces a burden on a user and surely prevents a printing finger U1 from moving when the finger U1 is pressed by a pen 41 during the drawing.

In this embodiment, additional information to prescribe the processing to be performed at the time of drawing is added to image data of nail designs stored in the nail design storage area 823 as described above. The additional information includes the information indicating which part of a nail design is to undergo the filling processing and which part of a nail design is to be drawn as a series of figure.

The drawing controller 815 determines whether to apply the drawing direction limiting processing and whether to perform the filling processing with reference to the additional information of the image data of a nail design.

Next, the behavior of and how to use the nail printing apparatus 1 in this embodiment is described.

In making a drawing with the nail printing apparatus 1, a user first powers on the apparatus 1 to start the control device 80.

The display controller 814 controls the display unit 26 to display the design selection screen.

The user operates an operation button 251 of the operation unit 25, for example, and selects a desired nail design among a plurality of nail designs displayed on the design selection screen.

This causes the operation unit 25 to output a selection instruction signal so that a nail design to be drawn on a nail T is selected.

Upon selection of a nail design, the control unit 81 allows the display unit 26 to display an instruction screen urging a user to attach pens 41 required for drawing the selected nail design to predetermined pen carriages 43 of the drawing head 42.

When red ink and ink containing gold glitter are needed, for example, the control unit 81 gives instructions through the display unit 26 about which pens 41 are to be attached to which pen carriages 43.

A user attaches predetermined types of pens 41 to predetermined pen carriages 43 in accordance with the instructions displayed on the screen.

A user may dare to attach pens 41 different from the instructions to produce a nail design with desired colors and texture.

The information on which pens 41 are attached to which pen carriages 43 may be read by the control unit 81 using a bar code, for example. In this case, nail designs which can be drawn with the pens 41 attached to the pen carriages 43 may be displayed on the design selection screen of the display unit 26 so that a user can select one of the nail designs.

Next, the user inserts a printing finger U1 in the finger receiving section 31 and inserts non-printing fingers U2 in the finger escape section 32 so as to fix the printing finger U1. The user then operates a drawing switch.

In FIG. 3, for example, the left ring finger is inserted in the finger receiving section 31 as a printing finger U1, and the other fingers are inserted in the finger escape section 32 as non-printing fingers U2.

Before the start of a drawing operation, the photographing controller 811 controls the photographing unit 50 so that the two cameras 51 photograph the printing finger U1 while the illuminators 52 illuminate the printing finger U1 in response to an instruction input from the drawing switch.

The photographing controller 811 thus obtains at least two images (nail images) of the nail T of the printing finger U1 inserted in the finger receiving section 31.

Next, the nail information detecting section 812 detects the contour (shape) of the nail T on the basis of the nail images.

The inclination angle detector 812*a* detects the inclination angle (curvature) of the nail T on the basis of the nail images.

After the nail information detecting section 812 and the inclination angle detector 812*a* detect the contour (shape) and inclination angle (curvature) of the nail T, the drawing data generating section 813 performs the fitting process to fit the image data of the nail design to the nail T on the basis of the nail information.

The drawing data generating section 813 then performs the curved surface correction on the image data of the nail design on the basis of the nail information. Thus, drawing data is generated.

Before the start of the drawing on the nail T, the drawing controller 815 moves the drawing unit 40 to the position above the pen warm-up section 61, and drives the solenoids 435 of the pen carriages 43 holding the pens 41 so that the pens 41 are ready for drawing.

The warm-up drawing is then performed on a drawing medium by drawing predetermined figures such as "○" and "∞".

The warm-up drawing may be performed by only the pens 41 required to draw a selected nail design or alternatively may be performed by all the pens 41.

After the generation of drawing data and the completion of the warm-up drawing, the drawing controller 815 outputs the drawing data to the drawing unit 40, drives the solenoids 435 of the pen carriages 43 holding the pens 41 required for the drawing so that the pens 41 are ready for drawing, and moves the drawing head 42 in X and Y directions as appropriate on the basis of the drawing data, to make a drawing on the nail T.

Each pen 41 is pressed against the surface of the nail T due to its own weight and makes a drawing while moving up and down along the shape of the surface of the nail T.

When a pen 41 is moved for drawing by a predetermined distance or longer in the width direction of the nail T during the drawing, the drawing controller 815 controls the X-Y drive section (i.e., the X-direction movement motor 46 and the Y-direction movement motor 48 constituting the head drive section 49) to perform the drawing direction limiting processing for an area where the absolute value of the inclination angle of the nail surface detected by the inclination angle detector 812*a* is equal to or larger than a threshold angle (θt) (i.e., for the steeply-inclined areas PA and PB, see FIG. 7). In the drawing direction limiting processing, the pen 41 is allowed to move from high to low above the X-Y plane of the nail T, but the pen 41 is prohibited from moving from low to high along the nail T.

The drawing controller 815 determines whether there is a fill area on which filling processing is to be performed, and determines whether to perform the drawing direction limiting processing with reference to the additional information of the image data of the nail design.

If there is a fill area, the drawing controller 815 controls the drawing unit 40 to draw the contour defining the fill area with the drawing direction limiting processing applied.

The drawing controller 815 then performs the filling processing to fill the area within the contour while moving the pen 41 in the length direction of the nail T within the contour.

If there is a series of figure part for which the moving distance of the pen 41 in the width direction of the nail T is shorter than a predetermined limit value, the drawing controller 815 determines not to perform the drawing direction limiting processing for this part, and controls the drawing unit 40 to draw the part as a series of figure even if the pen 41 moves from low to high along the nail T in some part of the steeply-inclined areas PA and PB.

This prevents misalignment or discontinuity of lines in the middle of the figure.

For making drawings on the nails T of a plurality of fingers, a finger with the nail T for which drawing has completed is pulled out of the finger receiving section 31 and a finger with a next drawing target nail T is inserted in the finger receiving section 31 as a printing finger U1. The nail images of the nail T are then obtained. These processes are then repeated.

When a pen(s) 41 is to be replaced, the drawing controller 815 moves the drawing head 42 to the position corresponding to the cover 23 for pen replacement. A user can open the cover 23 for pen replacement at this time to take out and replace a pen(s) 41.

As described above, the nail printing apparatus 1 in this embodiment detects the inclination angle of the surface of the nail T of a printing finger U1 with respect to the X-Y plane, and controls the X-direction movement motor 46 and the Y-direction movement motor 48, which constitute the head drive section 49, to perform the drawing direction limiting processing on an area of the surface of the nail T where the detected inclination angle is relatively large. In the drawing direction limiting processing, a pen 41 is moved from high to low above the X-Y plane of the nail T.

This prohibits a pen 41 from moving from low to high along the nail T on an edge part of the nail T having a large inclination angle. In other words, a pen 41 is prohibited from moving up the inclined surface.

This prevents a pen 41 from pressing a nail T and thus reduces burden on a user, and prevents a printing finger U1 from being pushed by a pen 41 and moved during drawing.

When filling a predetermined fill area, the drawing controller 815 controls the X-Y drive section (i.e., the X-direction movement motor 46 and the Y-direction movement motor 48 constituting the head drive section 49) so as to draw the contour of the fill area in the width direction of the nail T, and then perform filling processing in which a pen 41 is moved on the area within the contour in the length direction of the nail T perpendicular to the width direction of the nail T for drawing.

This prevents a pen 41 from moving from low to high along the nail T at the time of filling a predetermined fill area, preventing the pen 41 from pressing the nail T.

Further, in this embodiment, the drawing direction limiting processing is not applied to a part to be drawn as a series of figure. Specifically, the drawing direction limiting processing is not applied to an area of a series of figure for which the moving distance of a pen 41 for drawing in the width direction of the nail T is shorter than a predetermined limit value, even if the inclination angle of the surface of the nail T is equal to or larger than a threshold angle (βt). This prevents misalignment or discontinuity of lines in the middle of the figure. Such a short moving distance of a pen 41 makes a user free from the feeling that the pen 41 is pressing the nail T even when the pen 41 is moving up the inclined surface of the nail T. Displacement of the finger is thus avoided, achieving beautiful nail prints.

Drawing with pens 41 allows the use of wider variety of inks including various color materials, such as ink with high viscosity, ink containing gold and silver glitter, and white ink, compared with the use of conventional inkjet print heads.

This allows ink to produce bright color without a white base coat and saves the trouble of applying a base coat. Further, a design utilizing the ground color of nails T is possible, which expands the range of nail designs to be drawn.

The use of pens 41 having broad pen tips 412 or brush-type pens 41 enables quick and even application of an undercoat, a topcoat, and a color on the entire nail T. This saves a user the trouble of manually applying a base coat etc. and thus avoids degradation in image quality due to the presence of an uncoated area and uneven application, achieving beautiful finish of the nail art.

Further, since there is no limitation on the ink to be used, a wide variety of beautiful nail prints, such as gorgeous designs using ink containing glitter and designs having depth, gloss, and an air of luxuriousness, just like the ones applied in a nail salon, can be easily applied on nails T with the nail printing apparatus 1.

For example, ink with high viscosity, such as UV-curable material for gel nails can also be used. Thus, nail arts with beautiful finish and good durability are achieved just like the ones applied in a nail salon.

Further, since the nail information detecting section 812 detects the shape of nails etc. as nail information on the basis of nail images, drawing can be performed to conform to a user's nail T. Accordingly, beautiful nail arts free from uncoated areas and protrusion are achieved.

It should be understood that the present invention is not limited to the above-described embodiment but may be modified in various manners without departing from the spirit of the invention.

For example, in this embodiment, the nail information detecting section 812 detects the inclination angle of a nail T, the steeply-inclined area PA is determined to be an area enclosed by the edge Ea of the nail T and the boundary La at which the inclination angle θ is the threshold angle (θt), and the steeply-inclined area PB is determined to be an area enclosed by the edge Eb of the nail T and the boundary Lb at which the inclination angle θ is the threshold angle (−θt). The way of setting the steeply-inclined areas is, however, not limited to this.

For example, the nail information detecting section 812 may categorize a curved shape of nail T into a plurality of types, such as a "flat type", "medium-flat type", "standard type", "medium-round type", and "round type". The percentage of distance from the both edges of a nail T in its width direction to the respective boundaries with respect to the width of the nail T may be determined in advance for each type, and the steeply-inclined areas may be determined on the basis of the detected contour of a nail T.

In this embodiment, when a predetermined fill area is to be filled for forming French nail at the tip part of a nail T, the contour of the fill area is drawn first, and the area within the contour is then filled with a pen 41 moved in the length direction of the nail T (see FIGS. 7 and 8). The processing for filling a predetermined fill area, however, is not limited to this example.

Figure 11:
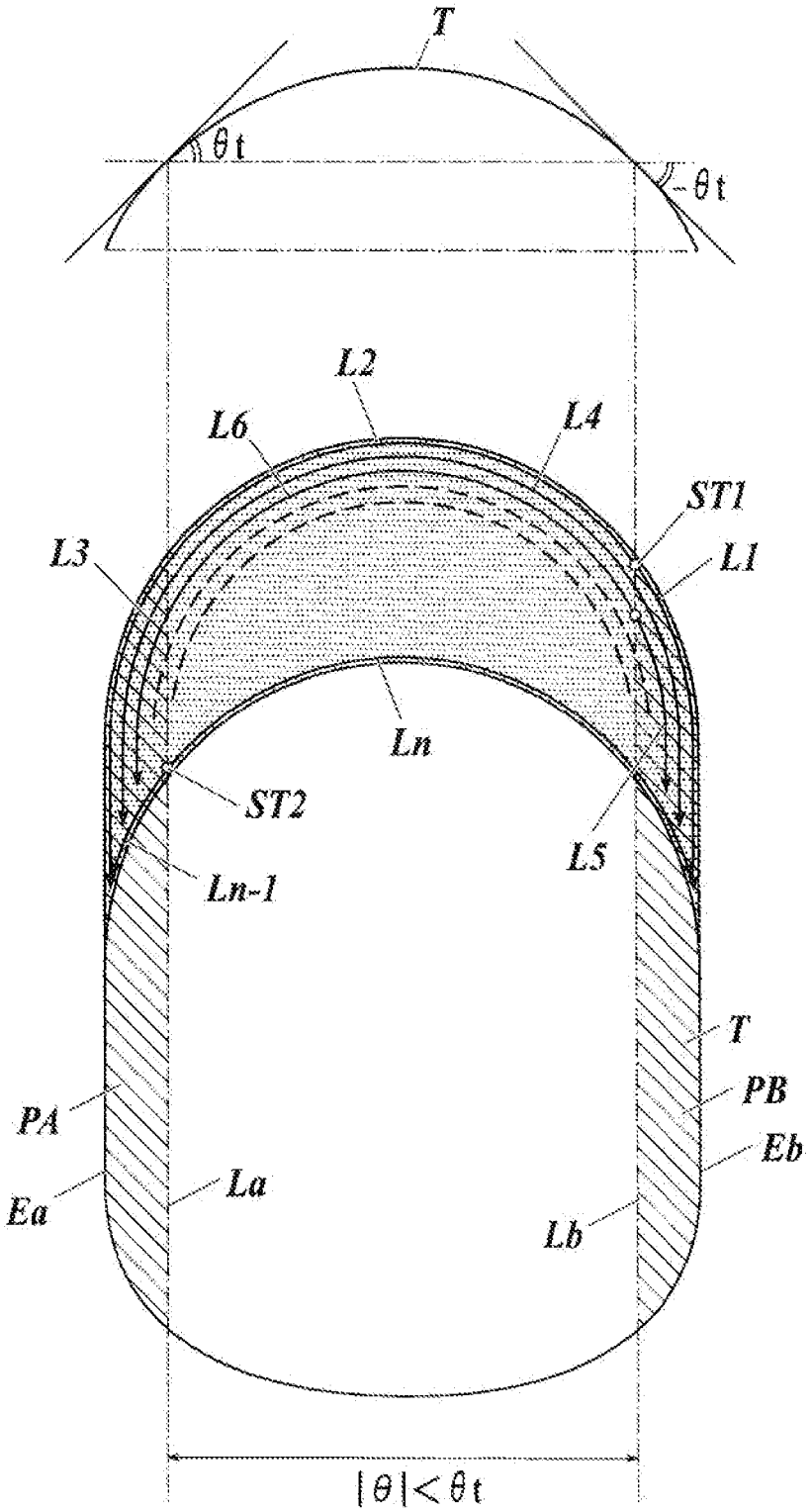
FIG. 11 shows a modification of the contour of a fill area and of filling processing to fill the fill area.

FIG. 11 shows a modification of the filling processing for drawing the contour of a fill area and for filling the fill area.

For example, as shown in FIG. 11, the line (line L1 in FIG. 11) to define the upper edge of the fill area is drawn from the first start point ST1 to the side edge of the nail T for one of the steeply-inclined areas of the nail T (i.e., the right steeply-inclined area PB in FIG. 11).

Then, the line L2 is drawn from the first start point ST1 to the opposite side edge for the center part of the nail T where the inclination angle θ of the nail surface satisfies |θ|<threshold angle (θt), and for the other of the steeply-inclined areas (i.e., the left steeply-inclined area PA in FIG. 11) of the nail T. The contour defining the upper edge of the fill area is thus drawn.

Further, the lines L3 and L4 and lines L5 and L6 . . . are drawn while the position of a pen 41 is shifted step by step in the length direction of the nail T.

Finally, the lines Ln−1 and Ln are drawn from the second start point ST2 as the contour defining the lower edge of the fill area.

The process to fill the fill area may thus be performed by repeatedly drawing lines while moving a pen 41 in the width direction of the nail T with the drawing direction limiting processing applied.

In the case in which a pen 41 is moved in the width direction of a nail T for drawing in this way, the pen 41 may be moved only in the direction from the highest position above the X-Y plane at the center of the nail T to the both-side edges (i.e., the low positions) of the nail T in its width direction.

The step of drawing the contour of the fill area may be omitted, in which case the entire fill area is filled with a pen 41 moved in the length direction of the nail T.

In this embodiment, the information on the processing to be performed at the time of drawing is added, as additional information, to image data of nail designs stored in the nail design storage area 823. The additional information includes the information indicating which part of a nail design is to undergo the filling processing and which part of a nail design is to be drawn as a series of figure. The drawing controller 815 determines whether to apply the drawing direction limiting processing and whether to perform the filling processing with reference to the additional information of the image data of a nail design. The way to determine what type of drawing processing to be performed, however, is not limited to this.

For example, instead of adding additional information to the image data of nail designs, a threshold value to extract figures for which the drawing direction limiting processing is not to be performed (e.g., a threshold value for the length of lines constituting the figures), and a threshold value to extract figures for which the filling processing is to be performed may be stored in the storage unit 82 etc. The drawing controller 815 may determine whether each drawing part exceeds the threshold values to determine what type of drawing processing to be performed.

The structure of the drawing unit 40 is not limited to this embodiment.

For example, the nail printing apparatus may be provided with a drawing unit which includes a rotatable pen carriage to hold a plurality of (e.g., eight) pens, a carriage rotating mechanism to rotate the pen carriage, and a pen up-and-down mechanism to move the pens held by the pen carriage up and down.

Such a drawing unit including the rotatable pen carriage can hold a plurality of types of pens at one time for drawing.

Such a drawing unit can easily draw complex and delicate designs which require multiple colors, such as a rainbow pattern requiring seven colors, a gradation pattern requiring a plurality of inks having gradually different densities, and an argyle pattern using various colors.

In this embodiment, solenoids are used as a pen up-and-down mechanism to move the pens 41 up and down. The configuration of the pen up-and-down mechanism, however, is not limited to this. A step motor, a DC motor, or a motor and ball screw may be used instead.

In this embodiment, the X-direction movement stage 45 and the Y-direction movement stage 47 to move the drawing head 42 is constituted of the combination of the X-direction movement motor 46 and the Y-direction movement motor 48, which are step motors, and the ball screw and guide (not shown). The structure to move the drawing head 42, however, is not limited to this.

The X-direction movement motor 46 and the Y-direction movement motor 48 may have any configuration as long as they can freely move the drawing head 42 right and left and backwards and forwards. For example, a configuration using a mechanism constituted of shafts, guides, and wires, which are used for typical inexpensive printers; or a configuration using servomotors may be employed.

In this embodiment, the pens use ink for drawing. The pens attached to the drawing head, however, are not necessarily the ones using ink for drawing.

For example, a pen attached to the drawing head may contain colorless/colored transparent liquid glue. After drawing with such a pen, power glitter may be sprinkled over or rhinestones may be attached to the nail before the glue dries up. This can produce more gorgeous nail designs.

The pens attached to the drawing head may contain liquid including perfume. Drawing with such pens allows a user to enjoy nail prints with fragrance.

In this embodiment, a plurality of (e.g., four) pens are attached to the drawing head at one time. The number of pens which can be attached to the drawing head at one time may be only one, in which case a user may manually replace the pen as appropriate. This can achieve a nail printing apparatus 1 provided with a pen inexpensively.

A mechanism to automatically replace a pen attached to a drawing head may be applied. In this case, a plurality of pens are stored in a standby space, and a pen is automatically selected from the pens and attached to the drawing head, for example. Such a configuration allows an increased number of pens to be stored in the apparatus.

In this embodiment, a slip of paper is used as a drawing medium for the pens' warm-up drawing, but the drawing medium is not limited to a slip of paper. Roll paper may alternatively be used as a drawing medium. In such a case, a medium sending mechanism is provided to manually or automatically feed and reel the drawing medium. In the case of such a roll drawing medium, a medium opening is provided through which the roll drawing medium is to be inserted and removed, instead of the medium insertion/output opening 24.

In this embodiment, the drawing data generating section 813 performs curved surface correction on the image data of a nail design to generate drawing data. Generation of drawing data by the drawing data generating section 813, however, is not essential for the present invention. Alternatively, the image data of a nail design may be converted as appropriate using a lookup table (LUT) in the drawing controller 815 without separate generation of drawing data. In this case, the converted data is output to the drawing head and drawing control is performed for a drawing suitable for the nail shape, for example.

In this embodiment, the shape of a nail T is detected as nail information, and drawing data is generated on the basis of the detected shape. Detection of the nail shape, however, is not essential for the present invention. In a case in which extraction of the contour of a nail T is not essential, such as a case of drawing a small design mark in the middle of a nail T, accurate recognition of a nail shape is not necessary, and drawing can be performed without the detection of a nail shape.

Further, images taken by the cameras 51 are not limited to still images but may be moving images. In this case, a camera 51 shoots a moving image, and the top view of the nail T is captured as appropriate from the taken image to be used for the detection of nail information.

In this embodiment, the nail image storage area 821, the nail information storage area 822, and the nail design storage area 823 are provided in the storage unit 82 of the control device 80. These storage areas 821, 822, and 823, however, does not necessarily have to be provided in the storage unit 82 of the control device 80, but another storage unit may be provided for these storage areas 821, 822, and 823.

In this embodiment, fingers are inserted in the nail printing apparatus 1 one by one so that printing is performed on the fingers one by one. The present invention, however, may also be applied to a nail printing apparatus that can perform printing on multiple fingers in succession.

In this case, for example, the range within which the pens are movable is increased for drawing for a larger range so that multiple printing fingers are inserted in the finger receiving section at once and drawing is performed on the printing fingers in succession.

Although various exemplary embodiments of the present invention have been shown and described, the invention is not limited to the embodiments shown but covers the scope of the claims and its equivalents.

What is claimed is:

1. A nail printing apparatus comprising:

a finger/toe placement section including a placement surface on which at least one of a finger and a toe is placed, the at least one of the finger and the toe having a nail on which a drawing is to be made;

a drawing tool which touches a surface of the nail of the at least one of the finger and the toe placed on the placement surface and makes the drawing on the surface of the nail;

a drive unit which moves the drawing tool; and a control unit which controls the drive unit, wherein when the drive unit moves the drawing tool while drawing on the surface of the nail, the control unit controls the drive unit so as to perform drawing direction limiting processing in which the drawing tool is allowed to move from a first point of the surface of the nail to a second point of the surface of the nail which is lower in height above the placement surface than the first point and the drawing tool is prohibited from moving from the second point to the first point in a first area and a second area of the surface of the nail, the first area being set on one side of a center line of the nail in a width direction of the nail, the second area being set on the other side of the center line of the nail in the width direction.

2. The nail printing apparatus according to claim 1, wherein the first area is including a part of an edge of the nail on the one side, and the second area is including a part of an edge of the nail on the other side.

3. The nail printing apparatus according to claim 1, wherein when a figure to be drawn on the nail has a shape spreading in such a way as to cover the first area and a third area which is between the first and second areas on the surface of the nail, the control unit controls the drive unit in such a way that the drawing tool is moved in the third area in the same way as in the first area for which the drawing direction limiting processing is performed, to perform the drawing in continuity over the first area and the third area; and when the figure has a shape spreading in such a way as to cover the second area and the third area, the control unit controls the drive unit in such a way that the drawing tool is moved in the third area in the same way as in the second area for which the drawing direction limiting processing is performed, to perform the drawing in continuity over the second area and the third area.

4. The nail printing apparatus according to claim 1, wherein when a design to be drawn on the nail includes a fill area, the control unit controls the drive unit to perform contour drawing processing in which the drawing tool is moved along a contour of the fill area to draw the contour, and then perform drawing processing for fill in which the drawing is performed with the drawing tool moved in the width direction and a length direction of the nail on an area within the contour; and in the contour drawing processing and the drawing processing for fill, the control unit performs the drawing direction limiting processing for the first area or the second area when a drawing area is included in the first area or the second area.

5. The nail printing apparatus according to claim 4, wherein when the fill area has a shape spreading in such a way as to cover the first area and a third area which is between the first and second areas on the surface of the nail, the control unit controls the drive unit in such a way that the drawing tool is moved in the third area in the same way as in the first area for which the drawing direction limiting processing is performed, to perform the drawing for the fill area in continuity over the first area and the third area; and when the fill area has a shape spreading in such a way as to cover the second area and the third area, the control unit controls the drive unit in such a way that the drawing tool is moved in the third area in the same way as in the second area for which the drawing direction limiting processing is performed, to perform the drawing for the fill area in continuity over the second area and the third area.

6. The nail printing apparatus according to claim 1, wherein the first area is an area enclosed by the edge of the nail on the one side and a first boundary extending in a length direction of the nail on the one side of the center line on the surface of the nail; and the second area is an area enclosed by the edge of the nail on the other side and a second boundary extending in the length direction on the other side of the center line on the surface of the nail.

7. The nail printing apparatus according to claim 6, further comprising an inclination angle detector which detects an inclination angle of the surface of the nail with respect to the placement surface, wherein each of the first boundary and the second boundary is set at a position where an absolute value of the inclination angle in the width direction is a predetermined threshold value.

8. The nail printing apparatus according to claim 7, wherein the control unit controls the drive unit so as to perform the drawing direction limiting processing for an area where the absolute value of the inclination angle of the surface of the nail in the length direction is equal to or larger than the threshold value.

9. A printing control method for a nail printing apparatus including a finger/toe placement section including a placement surface on which at least one of a finger and a toe is placed, the at least one of the finger and the toe having a nail on which a drawing is to be made; drawing tool which touches a surface of the nail of the at least one of the finger and the toe placed on the placement surface and makes the drawing on the surface of the nail; a drive unit which moves the drawing tool; and a control unit which controls the drive unit, the method comprising:

the control unit performing drawing direction limiting processing when the drawing tool is moved by the drive unit while drawing on the surface of the nail in a first area and a second area of the surface of the nail, the first area being set on one side of a center line of the nail in a width direction of the nail, the second area being set on the other side of the center line of the nail in the width direction, the drawing direction limiting processing being processing in which the drawing tool is allowed to be moved by the drive unit from a first point of the surface of the nail to a second point of the surface of the nail which is lower in height above the placement surface than the first point and the drawing tool is prohibited from being moved by the drive unit from the second point to the first point.

10. The printing control method for the nail printing apparatus according to claim 9, wherein when a figure to be drawn on the nail has a shape spreading in such a way as to cover the first area and a third area which is between the first and second areas on the surface of the nail, the control unit controls the drive unit in such a way that the drawing tool is moved by the drive unit in the third area in the same way as in the first area for which the drawing direction limiting processing is performed, to perform the drawing in continuity over the first area and the third area; and when the figure has a shape spreading in such a way as to cover the second area and the third area, the control unit controls the drive unit in such a way that the drawing tool is moved by the drive unit in the third area in the same way as in the second area for which the drawing direction limiting processing is performed, to perform the drawing in continuity over the second area and the third area.

11. The printing control method for the nail printing apparatus according to claim 9, wherein when a design to be drawn on the nail includes a fill area, the control unit controls the drive unit such that contour drawing processing is performed in which the drawing tool is moved by the drive unit along a contour of the fill area to draw the contour, and then drawing processing for fill is performed in which the drawing is performed with the drawing tool moved by the drive unit in the width direction and a length direction of the nail on an area within the contour; and in the contour drawing processing and the drawing processing for fill, the drawing direction limiting processing is performed by the control unit for the first area or the second area when a drawing area is included in the first area or the second area.

12. The printing control method for the nail printing apparatus according to claim 11, wherein when the fill area has a shape spreading in such a way as to cover the first area and a third area which is between the first and second areas on the surface of the nail, the control unit controls the drive unit in such a way that the drawing tool is moved by the drive unit in the third area in the same way as in the first area for which the drawing direction limiting processing is performed, to perform the drawing for the fill area in continuity over the first area and the third area; and when the fill area has a shape spreading in such a way as to cover the second area and the third area, the control unit controls the drive unit in such a way that the drawing tool is moved by the drive unit in the third area in the same way as in the second area for which the drawing direction limiting processing is performed, to perform the drawing for the fill area in continuity over the second area and the third area.

13. The printing control method for the nail printing apparatus according to claim 9, wherein the first area is an area enclosed by the edge of the nail on the one side and a first boundary extending in a length direction of the nail on the one side of the center line on the surface of the nail; and the second area is an area enclosed by the edge of the nail on the other side and a second boundary extending in the length direction on the other side of the center line on the surface of the nail.

14. The printing control method for the nail printing apparatus according to claim 13, further comprising the control unit detecting an inclination angle of the surface of the nail with respect to the placement surface, wherein each of the first boundary and the second boundary is set at a position where an absolute value of the inclination angle in the width direction is a predetermined threshold value.

15. The printing control method for the nail printing apparatus according to claim 14, wherein the drawing direction limiting processing is performed by the control unit for an area where the absolute value of the inclination angle of the surface of the nail in the length direction is equal to or larger than the threshold value.

16. A nail printing apparatus comprising:

a finger/toe placement section including a placement surface on which at least one of a finger and a toe is placed, the at least one of the finger and the toe having a nail on which a drawing is to be made;

a drawing tool which touches a surface of the nail of the at least one of the finger and the toe placed on the placement surface and makes the drawing on the surface of the nail;

a drive unit which moves the drawing tool; and a control unit which controls the drive unit, wherein when the drive unit moves the drawing tool while drawing on the surface of the nail, the control unit controls the drive unit so as to perform drawing direction limiting processing in which the drawing tool is allowed to move from a first point of the surface of the nail to a second point of the surface of the nail which is lower in height above the placement surface than the first point and the drawing tool is prohibited from moving from the second point to the first point in a first area and a second area of the surface of the nail, the first area being set on one side of a center line of the nail in a width direction of the nail, and being an area except a first specific area, the second area being set on the other side of the center line of the nail in the width direction, and being an area except a second specific area;

each of the first specific area and the second specific area is an area for which a specific figure is to be drawn, the specific figure being a series of figure in a design to be drawn on the nail and being a figure for which a moving distance of the drawing tool in the width direction is shorter than a predetermined limit value; and the control unit controls the drive unit so as to draw the specific figure in continuity without performing the drawing direction limiting processing in the first specific area and the second specific area.

17. The nail printing apparatus according to claim 16, wherein the first area is including a part of an edge of the nail on the one side, and the second area is including a part of an edge of the nail on the other side.

18. A printing control method for a nail printing apparatus including a finger/toe placement section including a placement surface on which at least one of a finger and a toe is placed, the at least one of the finger and the toe having a nail on which a drawing is to be made; a drawing tool which touches a surface of the nail of the at least one of the finger and the toe placed on the placement surface and makes the drawing on the surface of the nail; a drive unit which moves the drawing tool; and a control unit which controls the drive unit, the method comprising:

the control unit performing drawing direction limiting processing when the drawing tool is moved by the drive unit while drawing on the surface of the nail in a first area and a second area of the surface of the nail, the first area being set on one side of a center line of the nail in a width direction of the nail, and being an area except a first specific area, the second area being set on the other side of the center line of the nail in the width direction, and being an area except a second specific area, the drawing direction limiting processing being processing in which the drawing tool is allowed to be moved by the drive unit from a first point of the surface of the nail to a second point of the surface of the nail which is lower in height above the placement surface than the first point and the drawing tool is prohibited from moving from the second point to the first point, wherein each of the first specific area and the second specific area is an area for which a specific figure is to be drawn, the specific figure being a series of figure in a design to be drawn on the nail and being a figure for which a moving distance of the drawing tool in the width direction is shorter than a predetermined limit value; and the specific figure is drawn by the drawing tool moved by the drive unit in continuity without the drawing direction limiting processing in the first specific area and the second specific area.

* * * * *